US010600432B1

(12) United States Patent
Chu et al.

(10) Patent No.: US 10,600,432 B1
(45) Date of Patent: Mar. 24, 2020

(54) METHODS FOR VOICE ENHANCEMENT

(71) Applicant: Amazon Technologies, Inc., Seattle, WA (US)

(72) Inventors: Wai Chung Chu, San Jose, CA (US); Carlo Murgia, Santa Clara, CA (US); Hyeong Cheol Kim, Irvine, CA (US)

(73) Assignee: Amazon Technologies, Inc., Seattle, WA (US)

( * ) Notice: Subject to any disclaimer, the term of this patent is extended or adjusted under 35 U.S.C. 154(b) by 338 days.

(21) Appl. No.: 15/471,629

(22) Filed: Mar. 28, 2017

(51) Int. Cl.
*G10L 21/034* (2013.01)
*G10L 25/84* (2013.01)
*G10L 21/02* (2013.01)
*G10L 25/21* (2013.01)

(52) U.S. Cl.
CPC ..... *G10L 21/034* (2013.01); *G10L 21/0205* (2013.01); *G10L 25/21* (2013.01); *G10L 25/84* (2013.01)

(58) Field of Classification Search
CPC ..... G10L 21/0208; G10L 15/20; G10L 2021/02165; G10L 21/0316; G10L 25/93; G10L 21/02; G10L 21/0232; G10L 21/0324; G10L 21/034; G10L 25/78; G10L 25/81
See application file for complete search history.

(56) References Cited

U.S. PATENT DOCUMENTS 8,180,064 B1 * 5/2012 Avendano ..... G10L 21/0232 381/71.1
2006/0261992 A1 * 11/2006 Lusky ..... H03M 1/185 341/155
2008/0235011 A1 * 9/2008 Archibald ..... G10L 25/78 704/225
2010/0017203 A1 * 1/2010 Archibald ..... G10L 25/78 704/208
2011/0188671 A1 * 8/2011 Anderson ..... H04B 15/00 381/94.3
2012/0084084 A1 * 4/2012 Zhu ..... G10L 21/0208 704/233
2013/0282373 A1 * 10/2013 Visser ..... G10L 21/0208 704/233
2017/0011753 A1 * 1/2017 Herbig ..... H04R 3/00

FOREIGN PATENT DOCUMENTS

CN 102056026 * 11/2009 ..... G10L 25/03

* cited by examiner

*Primary Examiner* — Matthew H Baker
(74) *Attorney, Agent, or Firm* — Pierce Atwood LLP

(57) ABSTRACT

A system configured to perform power normalization for voice enhancement. The system may identify active intervals corresponding to voice activity and may selectively amplify the active intervals in order to generate output audio data at a near uniform loudness. The system may determine a variable gain for each of the active intervals based on a desired output loudness and a flatness value, which indicates how much a signal envelope is to be modified. For example, a low flatness value corresponds to no modification, with peak active interval values corresponding to the desired output loudness and lower active intervals being lower than the desired output loudness. In contrast, a high flatness value corresponds to extensive modification, with peak active interval values and lower active interval values both corresponding to the desired output loudness. Thus, individual words may share the same peak power level.

20 Claims, 20 Drawing Sheets

METHODS FOR VOICE ENHANCEMENT

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture and process audio data. The audio data may be used for voice commands and/or may be output by speakers. An output loudness of the audio data may vary, both between different devices and within audio data. For example, a first portion of audio data may correspond to a user being close to a microphone, whereas a second portion of audio data may correspond to the user being further away from the microphone, resulting in a decreased loudness for the second portion relative to the first portion. In addition, speech may be difficult to understand due to variations in loudness of different words or sentences.

To perform voice enhancement, devices, systems and methods are disclosed that performs power normalization and selectively amplifies voice data. For example, the system may identify active intervals in audio data that correspond to voice activity and may selectively amplify the active intervals in order to generate output audio data at a near uniform loudness. The system may determine a variable gain for each of the active intervals based on a desired output loudness and a flatness value, which indicates how much a signal envelope is to be modified. For example, a low flatness value corresponds to no modification, with peak active interval values corresponding to the desired output loudness and lower active intervals being lower than the desired output loudness. In contrast, a high flatness value corresponds to extensive modification, with peak active interval values and lower active interval values both corresponding to the desired output loudness. Thus, individual words may share the same peak power level.

Figure 1:
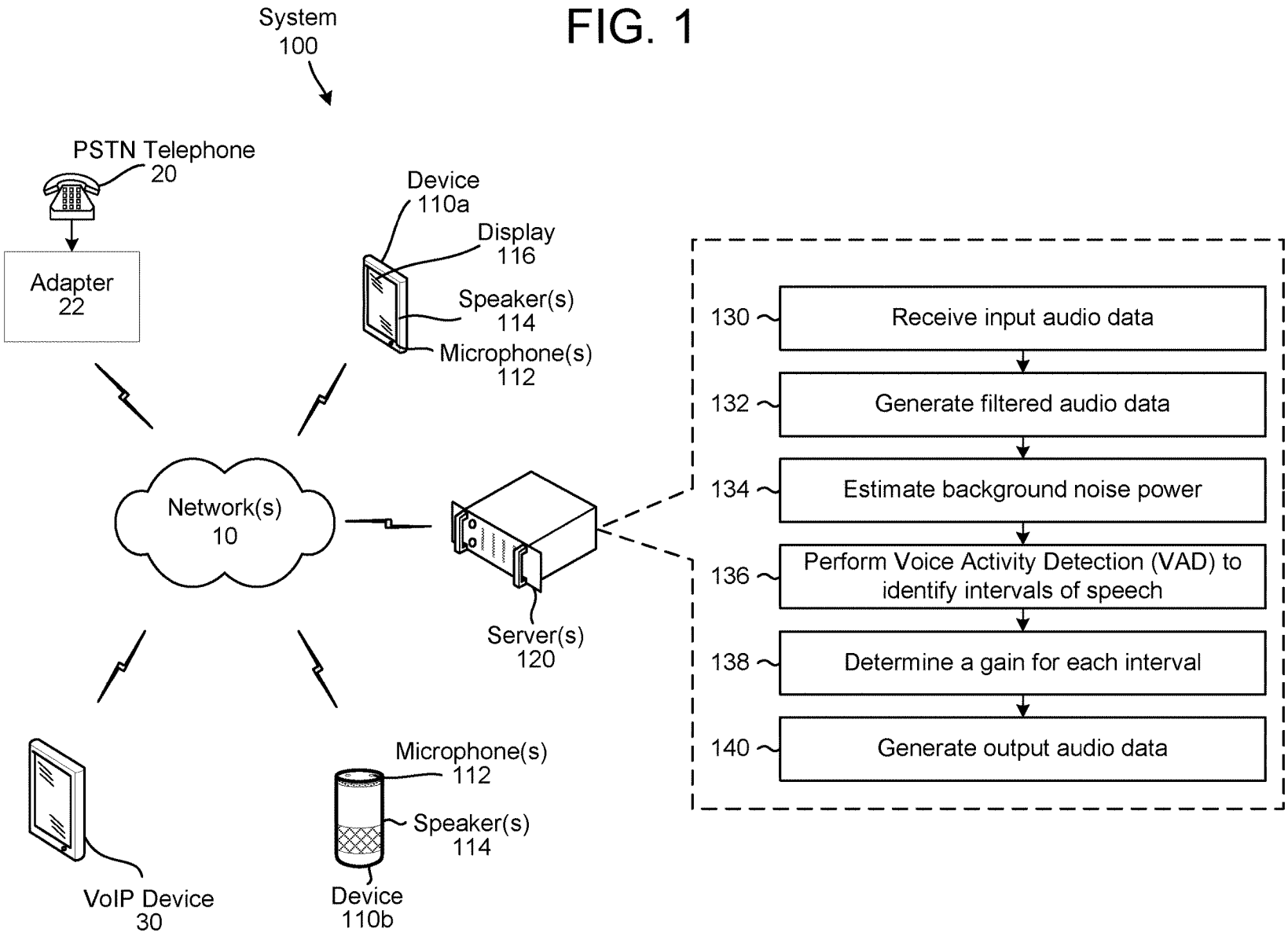
FIG. 1 illustrates a system according to embodiments of the present disclosure.

FIG. 1 illustrates a high-level conceptual block diagram of a system 100 configured to perform voice enhancement. Although FIG. 1, and other figures/discussion illustrate the operation of the system in a particular order, the steps described may be performed in a different order (as well as certain steps removed or added) without departing from the intent of the disclosure. As illustrated in FIG. 1, the system 100 may include a Voice over Internet Protocol (VoIP) device 30, a public switched telephone network (PSTN) telephone 20 connected to an adapter 22, a first device 110*a*, a second device 110*b* and/or a server(s) 120, which may all be communicatively coupled to network(s) 10.

The VoIP device 30, the PSTN telephone 20, the first device 110*a* and/or the second device 110*b* may communicate with the server(s) 120 via the network(s) 10. For example, one or more of the VoIP device 30, the PSTN telephone 20, the first device 110*a* and the second device 110*b* may send audio data to the server(s) 120 via the network(s) 10, such as a voice message. While the server(s) 120 may receive audio data from multiple devices, for ease of explanation the disclosure illustrates the server(s) 120 receiving audio data from a single device at a time. The server(s) 120 may be configured to receive the audio data and perform voice enhancement on the audio data, as will be discussed in greater detail below.

The VoIP device 30 may be an electronic device configured to connect to the network(s) 10 and to send and receive data via the network(s) 10, such as a smart phone, tablet or the like. Thus, the VoIP device 30 may send audio data to and/or receive audio data from the server(s) 120, either during a VoIP communication session or as a voice message. In contrast, the PSTN telephone 20 may be a landline telephone (e.g., wired telephone, wireless telephone or the like) connected to the PSTN (not illustrated), which is a landline telephone network that may be used to communicate over telephone wires, and the PSTN telephone 20 may not be configured to directly connect to the network(s) 10. Instead, the PSTN telephone 20 may be connected to the adapter 22, which may be configured to connect to the PSTN and to transmit and/or receive audio data using the PSTN and configured to connect to the network(s) 10 (using an Ethernet or wireless network adapter) and to transmit and/or receive data using the network(s) 10. Thus, the PSTN telephone 20 may use the adapter 22 to send audio data to and/or receive audio data from the second device 110*b* during either a VoIP communication session or as a voice message.

The first device 110*a* and the second device 110*b* may be electronic devices configured to send audio data to and/or receive audio data from the server(s) 120. The device(s) 110 may include microphone(s) 112, speakers 114, and/or a display 116. For example, FIG. 1 illustrates the second device 110*b* including the microphone(s) 112 and the speakers 114, while the first device 110*a* includes the microphone(s) 112, the speakers 114 and the display 116. While the second device 110*b* is illustrated as a speech-controlled device (e.g., second device 110*b* doesn't include a display 116), the disclosure is not limited thereto and the second device 110*b* may include the display 116 without departing from the disclosure. Using the microphone(s) 112, the device(s) 110 may capture audio data and send the audio data to the server(s) 120.

In some examples, the devices 110 may send the audio data to the server(s) 120 in order for the server(s) 120 to determine a voice command. For example, the first device 110*a* may send first audio data to the server(s) 120, the server(s) 120 may determine a first voice command represented in the first audio data and may perform a first action corresponding to the first voice command (e.g., execute a first command, send an instruction to the first device 110*a* and/or other devices to execute the first command, etc.). Similarly, the second device 110*b* may send second audio data to the server(s) 120, the server(s) 120 may determine a second voice command represented in the second audio data and may perform a second action corresponding to the second voice command (e.g., execute a second command, send an instruction to the second device 110*b* and/or other devices to execute the second command, etc.).

In some examples, to determine the voice command the server(s) 120 may perform Automatic Speech Recognition (ASR) processing, Natural Language Understanding (NLU) processing and/or command processing to determine the voice command. The voice commands may control the device(s) 110, audio devices (e.g., play music over speakers, capture audio using microphones, or the like), multimedia devices (e.g., play videos using a display, such as a television, computer, tablet or the like), smart home devices (e.g., change temperature controls, turn on/off lights, lock/unlock doors, etc.) or the like.

While the above examples illustrate the server(s) 120 determining a voice command represented in the audio data, the disclosure is not limited thereto and the server(s) 120 may perform voice enhancement on the audio data without determining a voice command. For example, the server(s) 120 may perform the voice enhancement and a separate device may determine the voice command. Additionally or alternatively, the server(s) 120 may perform voice enhancement on the audio data separate from any device determining a voice command without departing from the disclosure.

Figure 2:
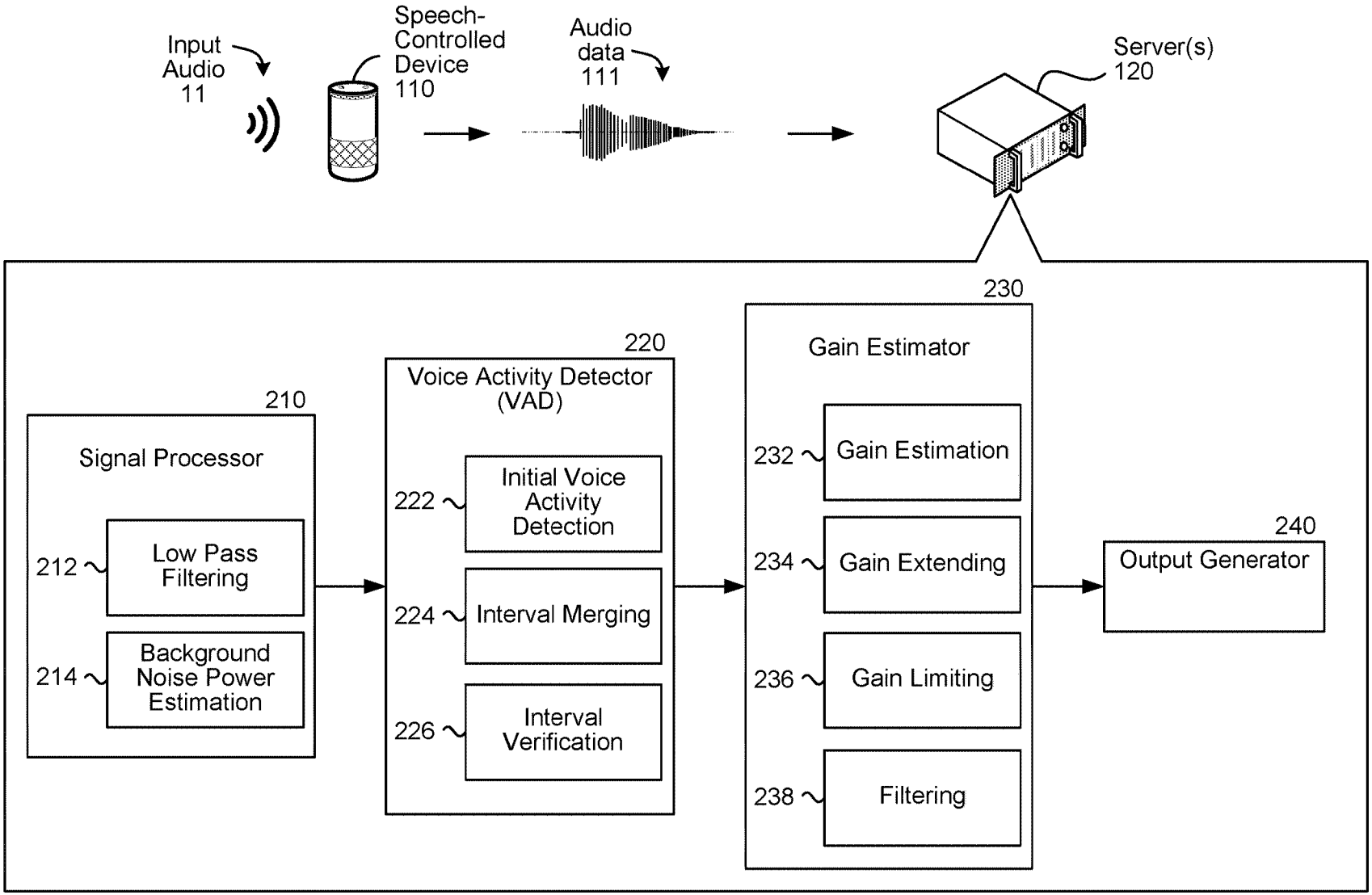
FIG. 2 is a conceptual diagram of how voice enhancement is performed according to examples of the present disclosure.

FIG. 2 is a conceptual diagram of how voice enhancement is performed according to examples of the present disclosure. As illustrated in FIG. 2, input audio 11 may be captured by a speech-controlled device 110 as audio data 111 and the audio data 111 may be sent to the server(s) 120. In order to perform voice enhancement on the audio data 111, the server(s) 120 may process the audio data 111 using a signal processor 210, a voice activity detector (VAD) 220, a gain estimator 230 and/or an output generate 240.

The signal processor 210 may modify the audio data 111 and estimate a background noise power associated with the audio data 111. For example, the signal processor 210 may perform (212) low pass filtering to clean the audio data 111 and may perform (214) background noise power estimation to estimate the background noise power at various points in the audio data 111, as will be discussed in greater detail below with regard to FIGS. 3-4 and 15.

The VAD 220 may detect voice activity by performing (222) initial voice activity detection (VAD), performing (224) interval merging and performing (226) interval verification, as will be discussed in greater detail below with regard to FIGS. 5, 13 and 14. VAD techniques may determine whether speech is present in a particular section of audio data based on various quantitative aspects of the audio data, such as the spectral slope between one or more frames of the audio data; the energy levels of the audio data in one or more spectral bands; the signal-to-noise ratios of the audio data in one or more spectral bands; or other quantitative aspects. In other embodiments, the VAD 220 may implement a limited classifier configured to distinguish speech from background noise. The classifier may be implemented by techniques such as linear classifiers, support vector machines, and decision trees. In still other embodiments, Hidden Markov Model (HMM) or Gaussian Mixture Model (GMM) techniques may be applied to compare the audio data to one or more acoustic models. The acoustic models may include models corresponding to speech, noise (such as environmental noise or background noise), or silence. Still other techniques may be used to determine whether speech is present in the audio data.

The gain estimator 230 may estimate the gain by performing (232) gain estimation, performing (234) gain extending, performing (236) gain limiting and performing (238) filtering of the gain values, as will be discussed in greater detail below with regard to FIGS. 6-9 and 11-12.

Figure 10:
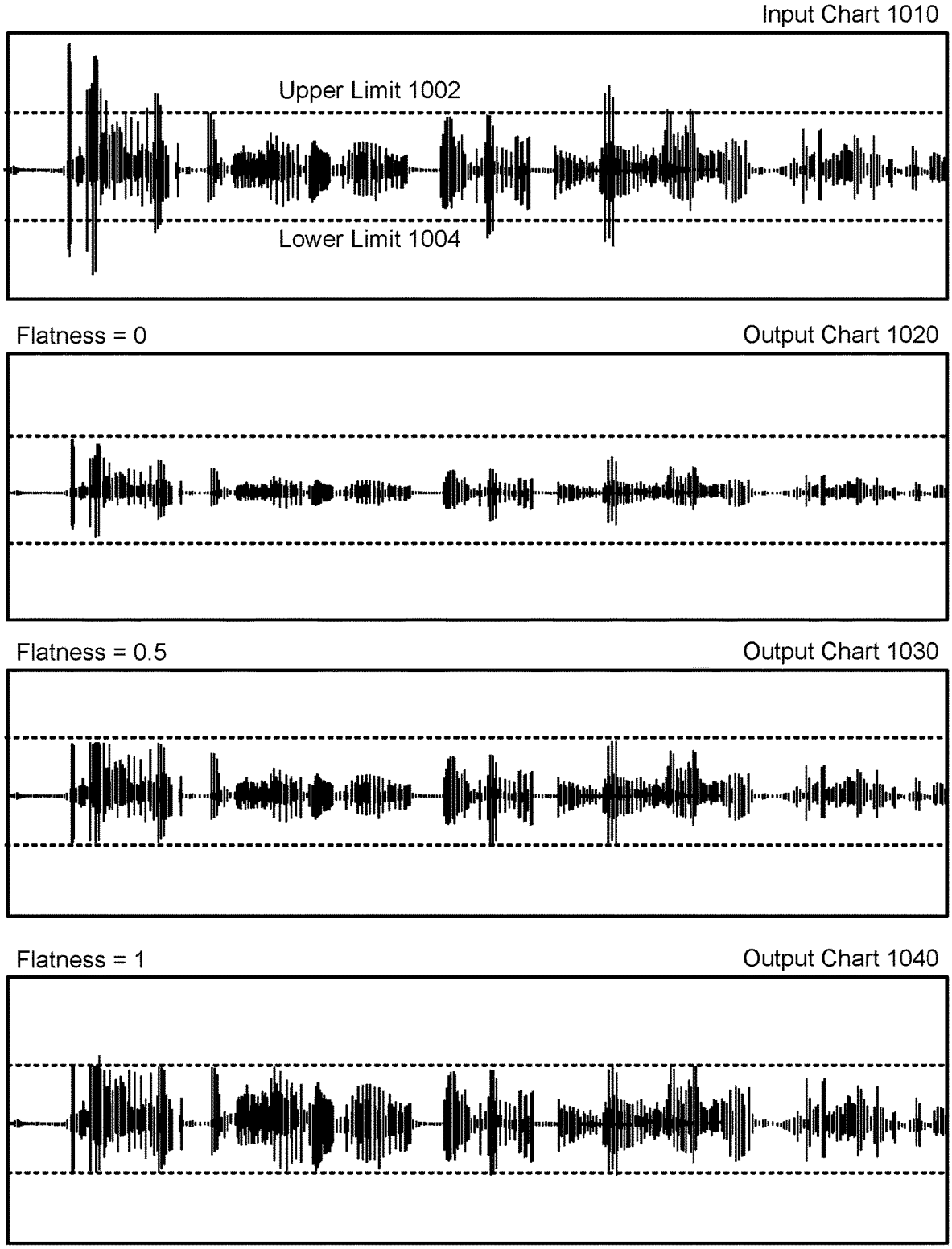
FIG. 10 illustrates examples of input audio data and output audio data based on different flatness values according to examples of the present disclosure.

The output generator 240 may generate output audio data by applying the determined gain to the audio data, as will be discussed in greater detail below with regard to FIG. 10.

As illustrated in FIG. 1, the server(s) 120 may receive (130) input audio data and may generate (132) filtered audio data. For example, the server(s) 120 may receive the input audio data from the PSTN telephone 20, the VoIP device 30, the first device 110*a* and/or the second device 110*b* and may perform low pass filtering or "smoothing" on the input audio data to generate the filtered audio data.

Figure 3:
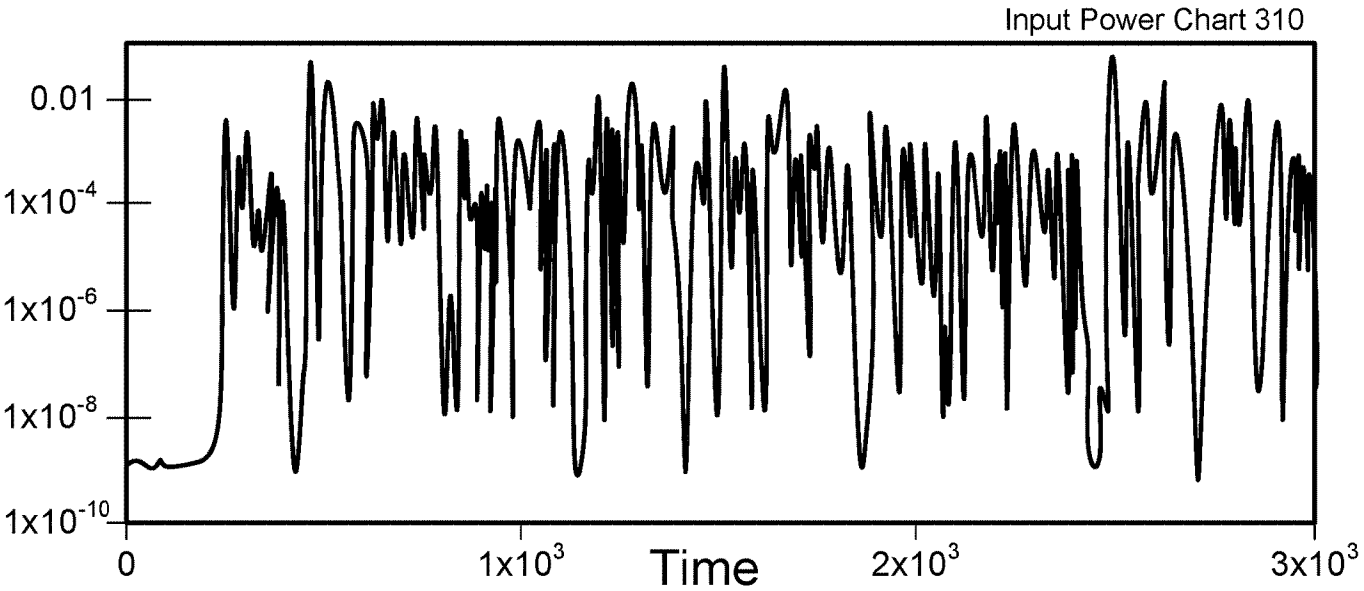
FIG. 3 illustrates an example of power of input audio data.
Figure 4:
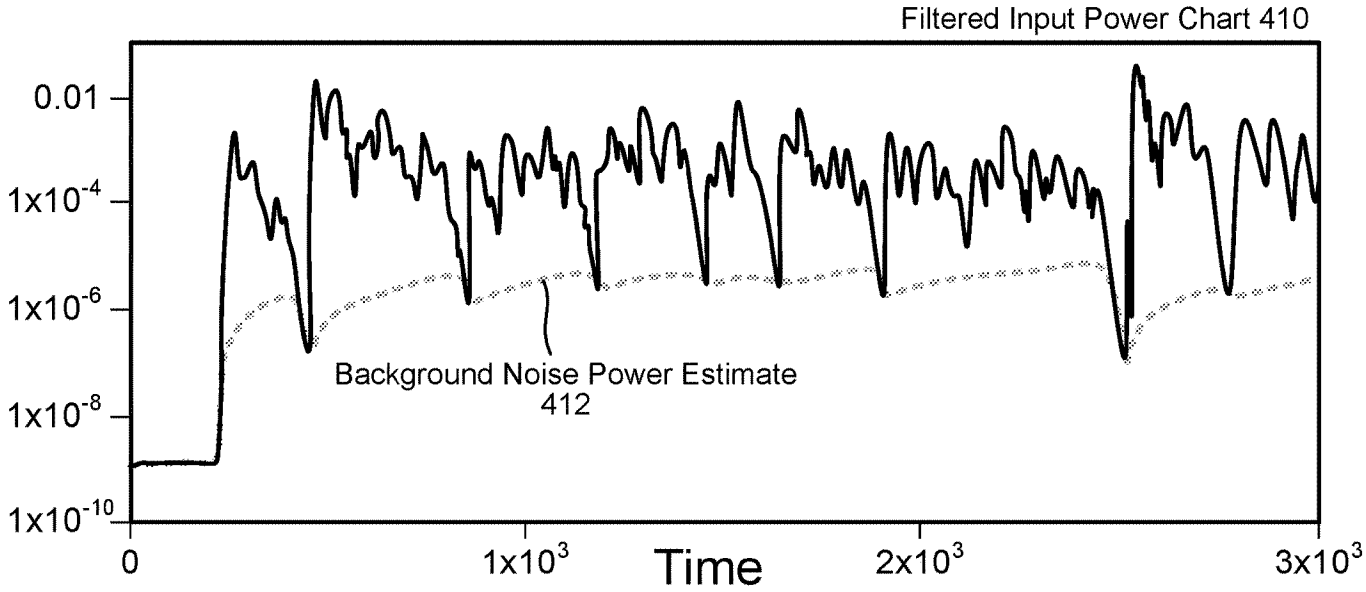
FIG. 4 illustrates an example of power of smoothed input audio data and a background noise power estimate according to examples of the present disclosure.

FIG. 3 illustrates an example of power of the input audio data in input power chart 310, while FIG. 4 illustrates an example of power of the filtered audio data in filtered input power chart 410. The input power chart 310 and the filtered input power chart 410 plot a power value for each audio sample (e.g., over time), with FIGS. 3-4 illustrating power values for 3,000 audio samples. As illustrated in FIG. 4, filtering the input audio data removes rapid fluctuations and results in a more detailed representation of the audio data. For example, the filtered input power chart 410 illustrates patterns corresponding to series of spoken words, with periods of relatively low power values separating the individual words.

As used herein, an audio sample may refer to a single data point while an audio frame may refer to a series of consecutive audio samples (e.g., 128 audio samples included in a single audio frame). For ease of explanation, the drawings and corresponding description illustrate examples that refer to performing steps associated with an audio frame instead of an audio sample or vice versa. However, the disclosure is not limited thereto and the steps may be performed based on the audio frame and/or the audio sample without departing from the disclosure.

After generating the filtered audio data, the server(s) 120 may estimate (134) background noise power using the filtered audio data. For example, FIG. 4 illustrates a background noise power estimate 412 that tracks the filtered input power values, with values of the background noise power estimate 412 corresponding to minimum values in the filtered input power chart 410. The steps of generating the background noise power estimate 412 will be described in greater detail below with regard to FIG. 15. In some examples, the server(s) 120 may use three parameters to generate the filtered audio data and/or to estimate the background noise power: a power adaptation factor, a noise adaptation factor, and a noise increment minimum.

Using the filtered audio data, the server(s) 120 may perform (136) Voice Activity Detection (VAD) to identify intervals of speech. For example, the server(s) 120 may determine a peak power among all audio frames and may determine a threshold value by multiplying the peak power by a power factor value. The power factor value may vary based on user preferences and/or other settings, with a higher power factor value increasing the threshold value (e.g., associating less audio data with voice activity) and a lower power factor decreasing the threshold value (e.g., associating more audio data with voice activity).

After determining the threshold value, the server(s) 120 may use the threshold value to determine active audio frames (e.g., audio frames corresponding to voice activity) and inactive audio frames (e.g., audio frames that do not correspond to voice activity). For example, the server(s) 120 may determine that first audio frames in the filtered audio data that have power values below the threshold value are inactive and that second audio frames in the filtered audio data that have power values above the threshold value are active. However, the disclosure is not limited thereto and the server(s) 120 may not determine that all of the second audio frames are active. Instead, the server(s) 120 may determine that the first audio frames with power below the threshold value are inactive and that second audio frames are remaining audio frames that have power values above the threshold value. The server(s) 120 may determine that a first portion of the second audio frames are inactive when the power value is larger than the noise adaptation factor multiplied by the background noise power estimate. Thus, the server(s) 120 may determine that a second portion of the second audio frames, which have power values smaller than the noise adaptation factor multiplied by the background noise power estimate, are active. The threshold value may avoid the classification of low power frames as being active, especially at the beginning where the recursive background noise power estimate is less accurate.

Figure 5:
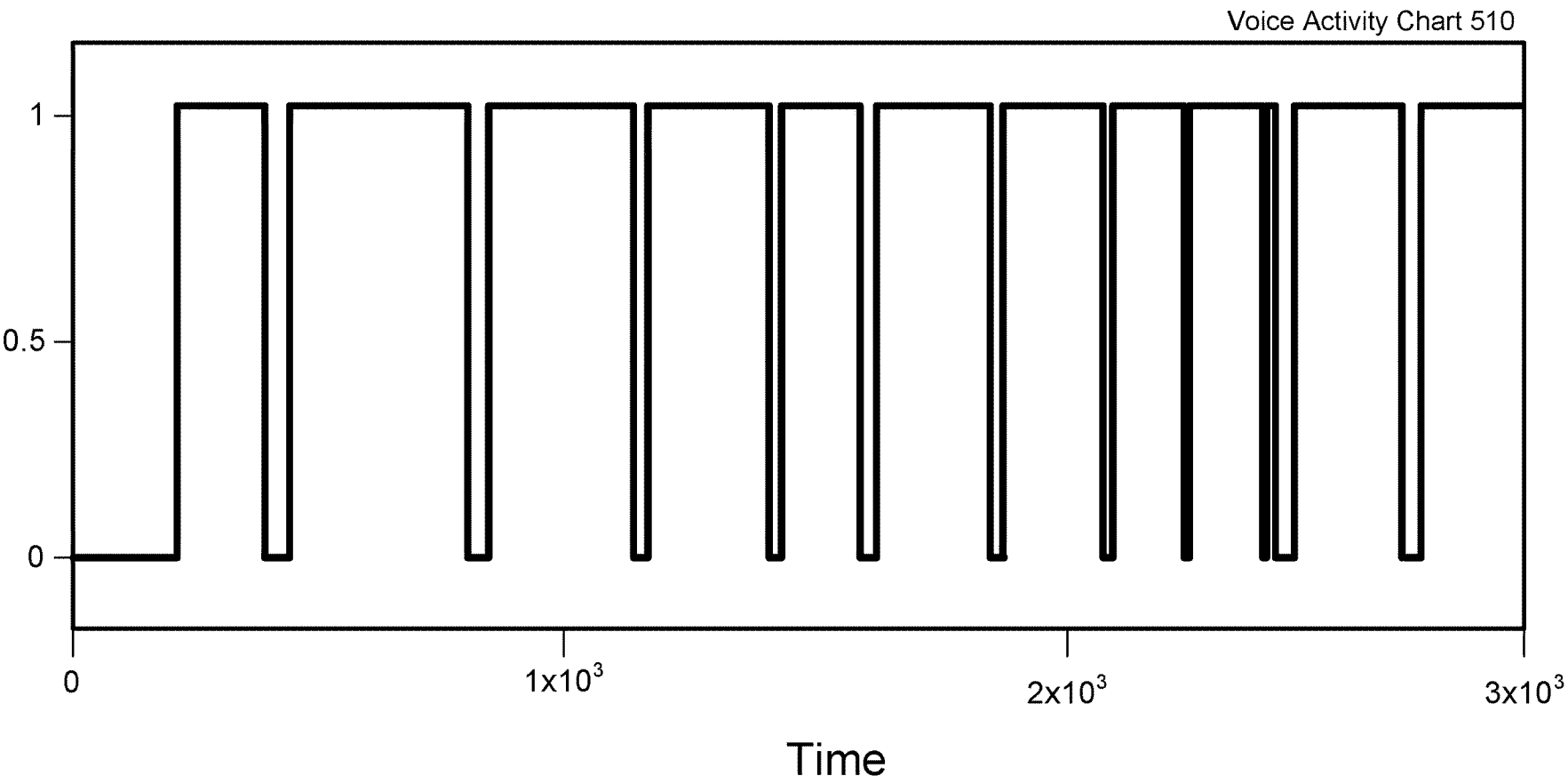
FIG. 5 illustrates an example of voice activity detection results according to examples of the present disclosure.

FIG. 5 illustrates an example of voice activity detection results according to examples of the present disclosure. As illustrated in FIG. 5, a voice activity chart 510 groups active audio frames into active intervals and inactive audio frames into inactive intervals, such that active intervals are separated by inactive intervals. The active intervals are relatively longer and correspond to voice activity (e.g., spoken words), whereas the inactive intervals are relatively shorter and do not correspond to voice activity (e.g., silence between words). As illustrated in FIG. 5, the 3,000 audio samples may be separated into 12 inactive intervals and 12 active intervals. For example, the third interval is centered around the 1,000th audio sample and the seventh interval includes the 2,000th audio sample. To perform voice enhancement, the server(s) 120 may apply gain to the active intervals while applying less gain to the inactive intervals.

For ease of illustration, FIGS. 3-5 only illustrates a small window of data points (e.g., 3,000 audio samples). However, the disclosure is not limited thereto and the server(s) 120 may consider any length of audio data and/or any number of audio samples without departing from the disclosure. For example, 30 seconds of audio data may correspond to 3,840 audio samples. Thus, while FIG. 5 only illustrates twelve intervals corresponding to 3,000 audio samples, the input audio data may instead include 3,840 audio samples and correspond to sixteen intervals, as illustrated in FIG. 6.

In order to perform power normalization, the server(s) 120 may determine (138) a gain for each interval. In some examples, the server(s) 120 may determine a minimum gain for all of the active intervals, resulting in output audio data that preserves an original signal envelope of the input audio data. For example, active intervals with higher peak power values may be closer to the desired output level while active intervals with lower peak power values may be further from the desired output level in the output audio data.

Figure 6:
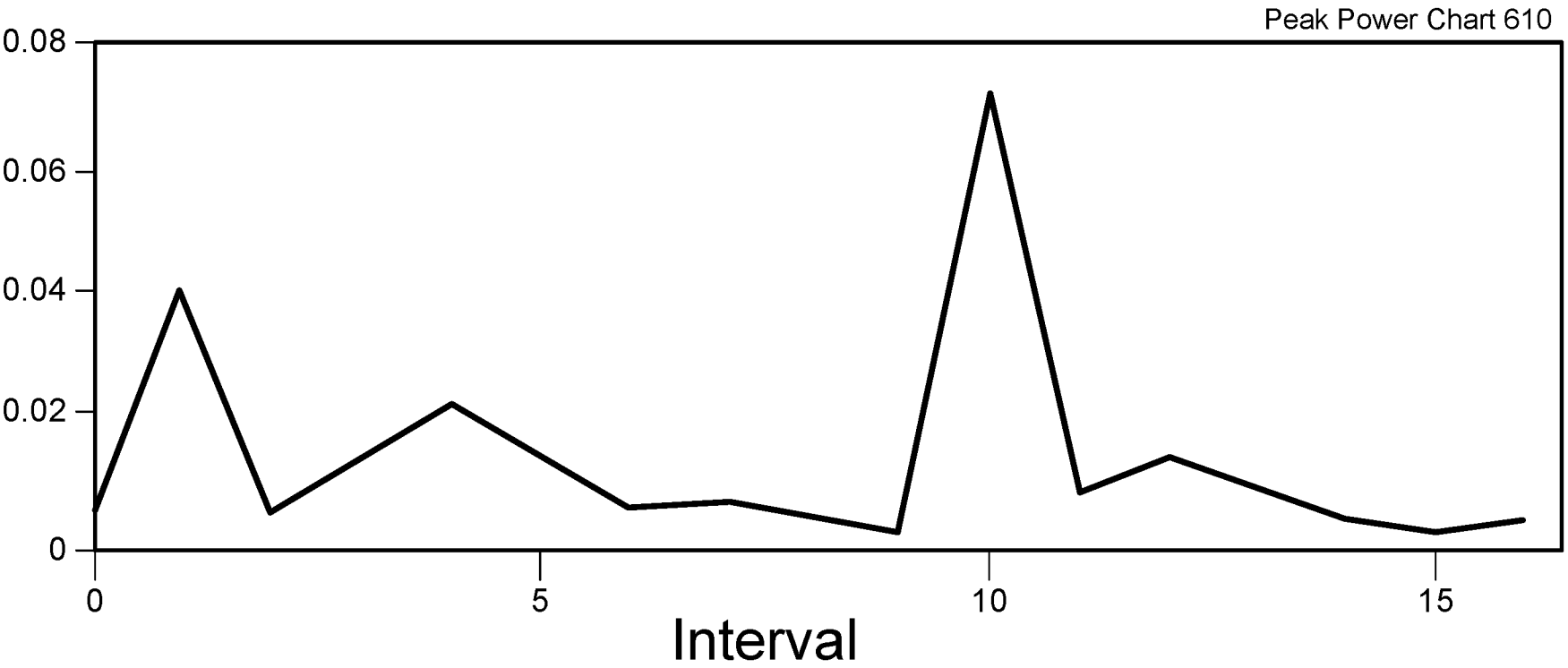
FIG. 6 illustrates an example of peak power for each interval according to examples of the present disclosure.
Figure 7A:
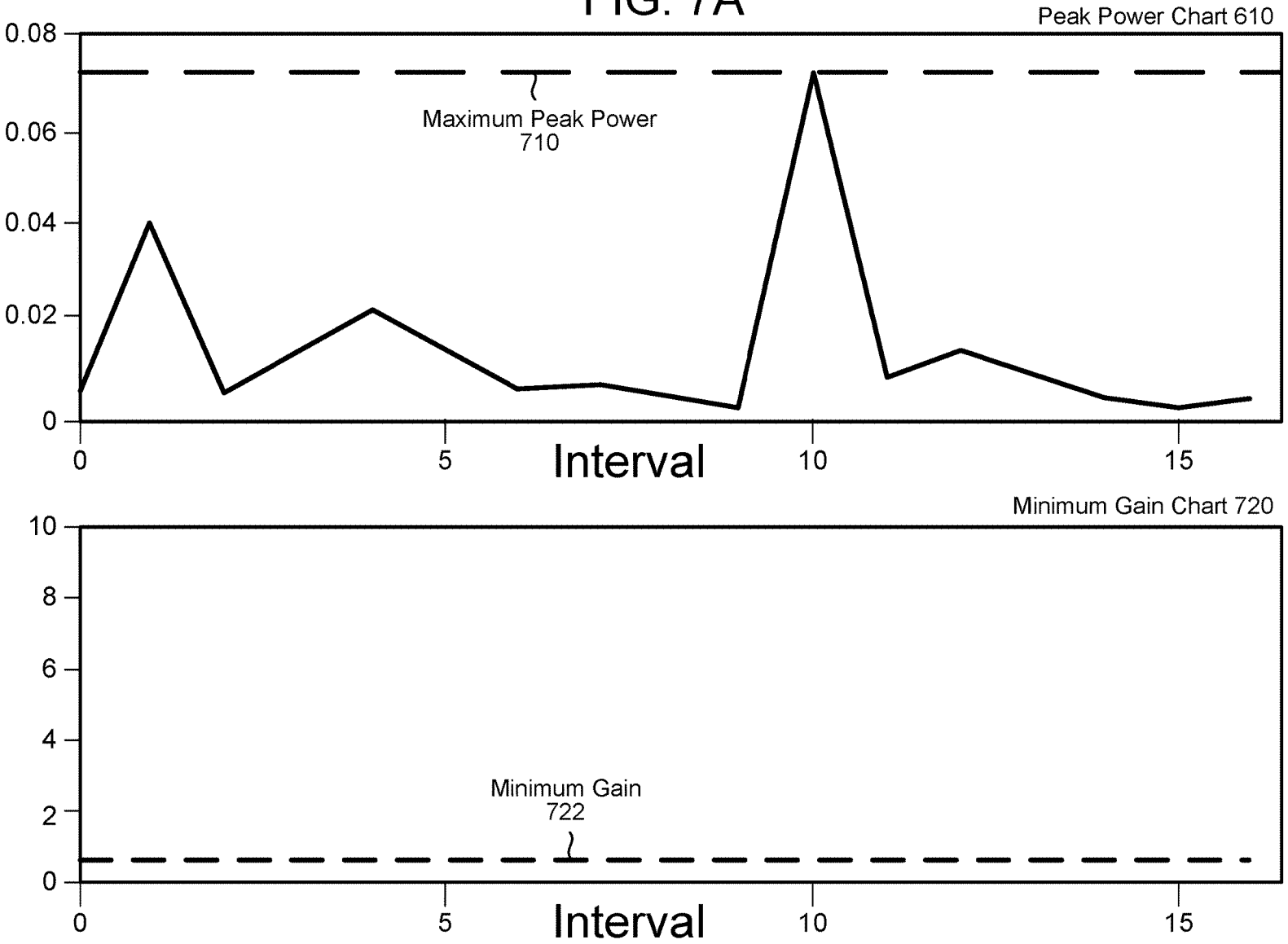
FIGS. 7A-7B illustrate examples of minimum gain and interval gains according to examples of the present disclosure.

As illustrated in FIG. 6, peak power chart 610 illustrates peak power values for each interval, ranging from a minimum peak power for the 15th interval to a maximum peak power value for the 10th interval. As illustrated in FIG. 7A, the server(s) 120 may determine that the 10th interval corresponds to a maximum peak power 710 of all of the intervals. Therefore, the server(s) 120 may calculate a minimum gain 722 for all of the intervals based on the maximum peak power 710, as illustrated in minimum gain chart 720. In some examples, all of the active intervals may be modified using the minimum gain 722, resulting in output audio data that does not exceed the desired power level but has relatively low peak power values for many of the intervals.

In other examples, each of the intervals may be modified using an individual gain determined based on a peak power value associated with the interval. For example, the server(s) 120 may determine a first peak value in the first interval (e.g., audio samples 200-400) and may determine a first gain based on the first peak value, may determine a second peak value in the second interval (e.g., audio samples 450-800) and may determine a second gain based on the second peak value, and so on for each of the 12 active intervals. Using the individual gains results in output audio data that modifies the original signal envelope of the input audio data. For example, all active intervals in the output audio data have the same power level (e.g., desired power level) regardless of a corresponding peak power value in the input audio data.

Figure 7B:
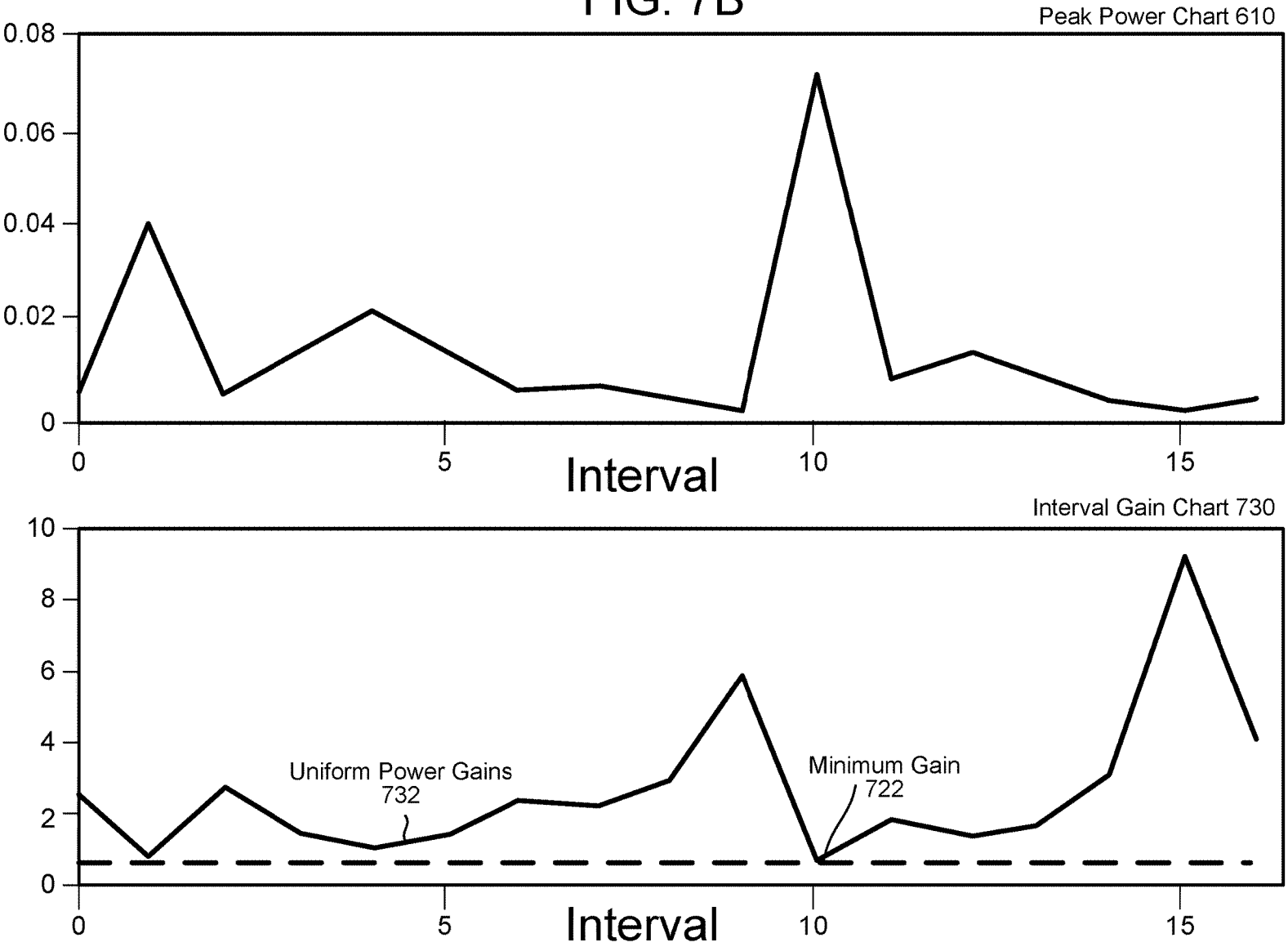

FIG. 7B illustrates an interval gain chart 730 that represents uniform power gains 732 that vary based on the interval. The server(s) 120 may determine the gain for each interval by dividing a desired power level by the peak power value for the interval (e.g., in Watts), or by subtracting the peak power value for the interval from the desired power level (e.g., in dB or dBm). For example, the 15th interval corresponds to a maximum gain (e.g., just below ten) to compensate for having a minimum peak power value. Similarly, the 9th interval has a second highest gain (e.g., around six) as the 9th interval has a second lowest peak power value, whereas the 10th interval corresponds to the minimum gain 722 as the 10th interval has the maximum peak power 710.

In some examples, the server(s) 120 may determine a gain for each interval based on a flatness value between zero and one. For example, the server(s) 120 may determine the gain for each interval based on the following equation:

$$g'=(g-\min(g))*\text{flatness}+\min(g) \quad (1)$$

where g' is the output gain, g is the individual gain for the interval (e.g., uniform power gains 732 illustrated in FIG. 7B), min(g) is the minimum gain 722, and flatness is the flatness value (e.g., 0≤flatness≤1). Thus, when the flatness value is equal to zero, the flatness value removes the individual gain and the output gain is equal to the minimum gain 722 for all intervals, represented by minimum gain chart 720 illustrated in FIG. 7A. In contrast, when the flatness value is equal to one the minimum gain cancels out and the output gain is equal to the uniform power gains 732 (e.g., g), as illustrated in FIG. 7B. If the flatness value is between 0 and 1, the output gain is based on a percentage of the individual gain for each interval above the minimum gain.

Figure 8:
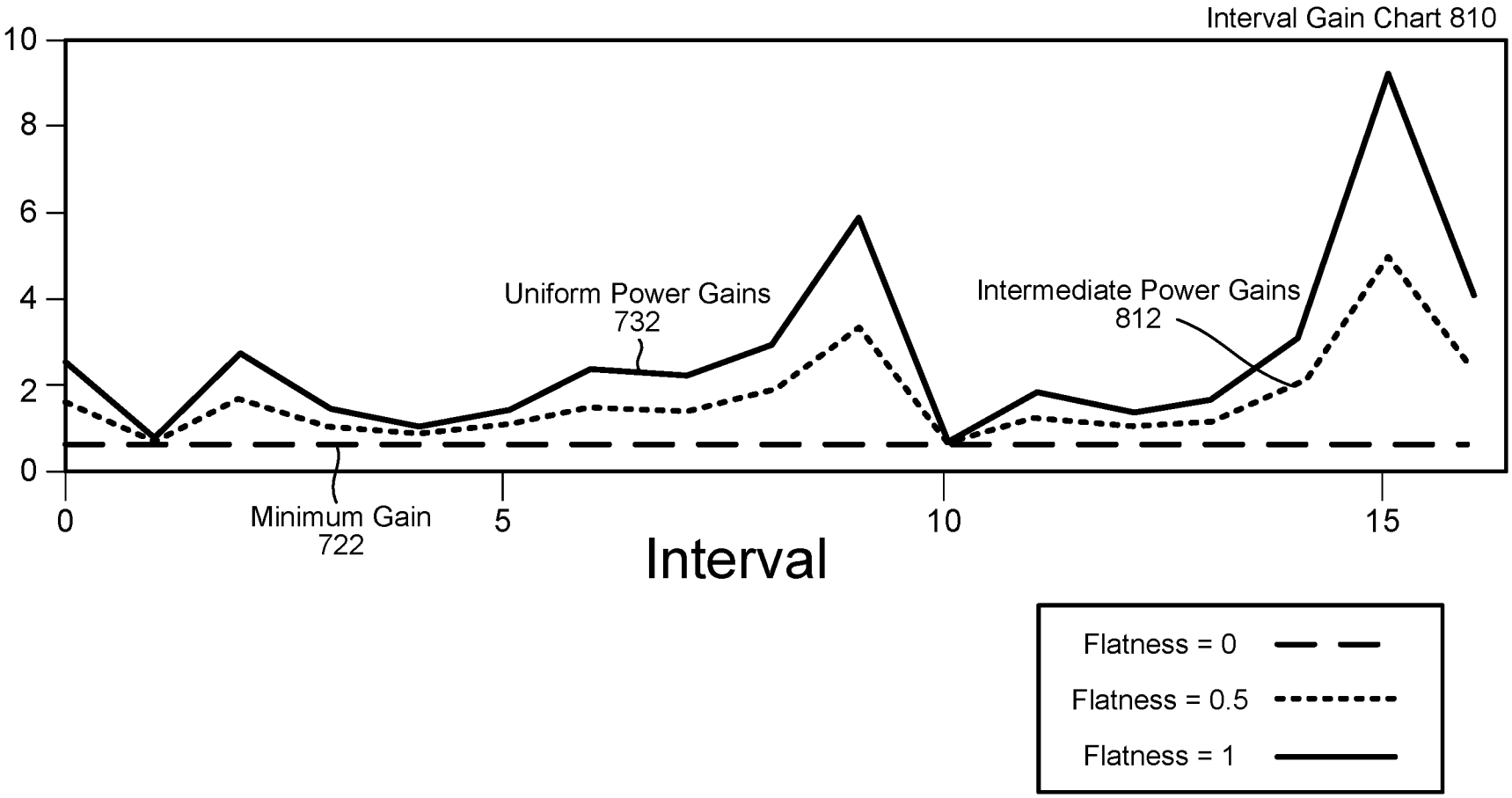
FIG. 8 illustrates examples of interval gains based on a flatness value according to examples of the present disclosure.

FIG. 8 illustrates examples of interval gains based on a flatness value according to examples of the present disclosure. As illustrated in FIG. 8, interval gain chart 810 illustrates the minimum gain 722 (e.g., flatness value equal to 0), the uniform power gains 732 (e.g., flatness value equal to 1) and intermediate power gains 812 (e.g., flatness value equal to 0.5). If the flatness value is increased above 0.5, the intermediate power gains 812 would increase proportionally up to the maximum (e.g., uniform power gains 322), whereas if the flatness value is decreased below 0.5, the intermediate power gains 812 would decrease proportionally up to the minimum gain 722.

Figure 9:
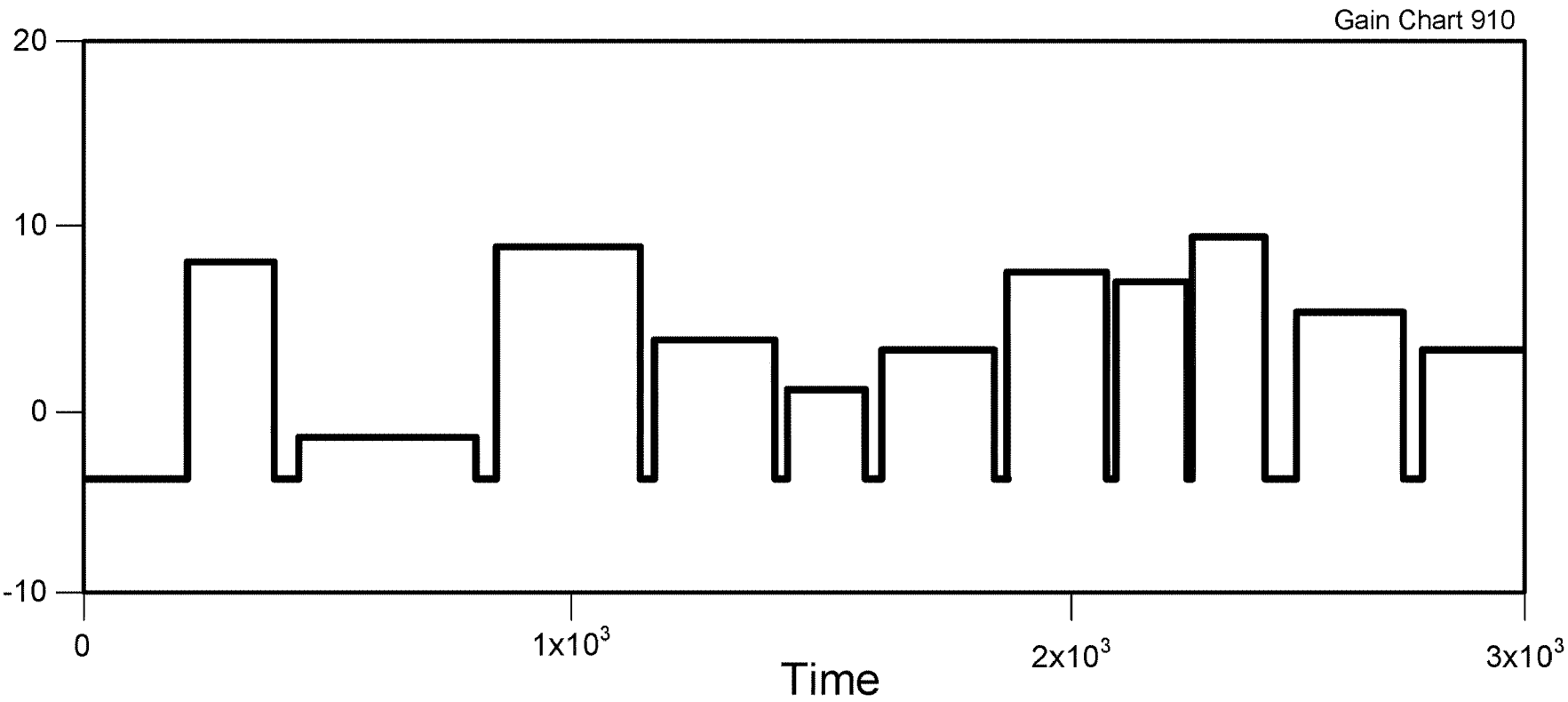
FIG. 9 illustrates an example of output gains according to examples of the present disclosure.

FIG. 9 illustrates an example of output gains according to examples of the present disclosure. As illustrated in FIG. 9, a gain chart 910 illustrates the gain applied to each audio sample. Thus, the individual gains for each interval illustrated in FIG. 8 is combined with the voice activity chart 510 to selectively increase the gain for active intervals while decreasing and/or not changing the gain for inactive intervals.

After determining the gain for each interval, the server(s) 120 may generate (140) output audio data. FIG. 10 illustrates examples of output audio data based on different flatness values. For example, input chart 1010 illustrates input audio data exceeding an upper limit 1002 and a lower limit 1004. Using a flatness value of 0, the server(s) 120 may generate output chart 1020, which maintains the signal envelope of the input audio data but normalizes the peak power such that a maximum peak power is equal to the upper limit 1002 and the minimum peak power is equal to the lower limit 1004. Using a flatness value of 0.5, the server(s) 120 may generate output chart 1030, which modifies the signal envelope to increase peak power values of active intervals. Using a flatness value of 1, the server(s) 120 may generate output chart 1040, which modifies the signal envelope such that peak power for each active interval is roughly the same.

In some examples, a power level of output audio data may exceed a desired output loudness. For example, the server(s) 120 may determine a gain based on an average power in an active interval instead of a peak power. Thus, instead of only the peak power reaching the desired output loudness, a larger portion of the active interval reaches the desired output loudness, with the peak power exceeding the desired output loudness.

To prevent the output audio data from exceeding the desired output loudness, the server(s) 120 may include a limiter that reduces the gain for portions of the output audio data that would otherwise exceed the desired output loudness. For example, the server(s) 120 may determine a power level of the output audio data by multiplying the gain by the peak power. If the power level of the output audio data exceeds the desired output loudness, the server(s) 120 may determine a new gain based on the desired output loudness and the peak power. For example, the server(s) 120 may divide the desired output loudness by the peak power to determine the new gain. In addition to determining the new gain, the server(s) 120 may determine a gain drop from the previous gain to the new gain.

To avoid an abrupt drop in gain, the server(s) 120 may use the gain drop to lower the gain in neighboring audio frames surrounding the peak. For example, the server(s) 120 may determine an incremental gain by dividing the gain drop by a number of audio frames and may use the incremental gain to transition from the overall gain to the gain drop over the course of the number of audio frames. To illustrate an example, if the number of audio frames is equal to twenty, the server(s) 120 may transition from the overall gain to the gain drop over twenty audio frames, with a gain of each audio frame decreasing by the incremental gain. After the peak, the server(s) 120 may transition from the gain drop to the overall gain over twenty audio frames, with a gain of each audio frame increasing by the incremental gain. Thus, the server(s) 120 may slowly transition to the gain drop without an abrupt drop in the gain. The server(s) 120 may then determine the final gain sequence by adding the overall gain to the gain drop.

Figure 11:
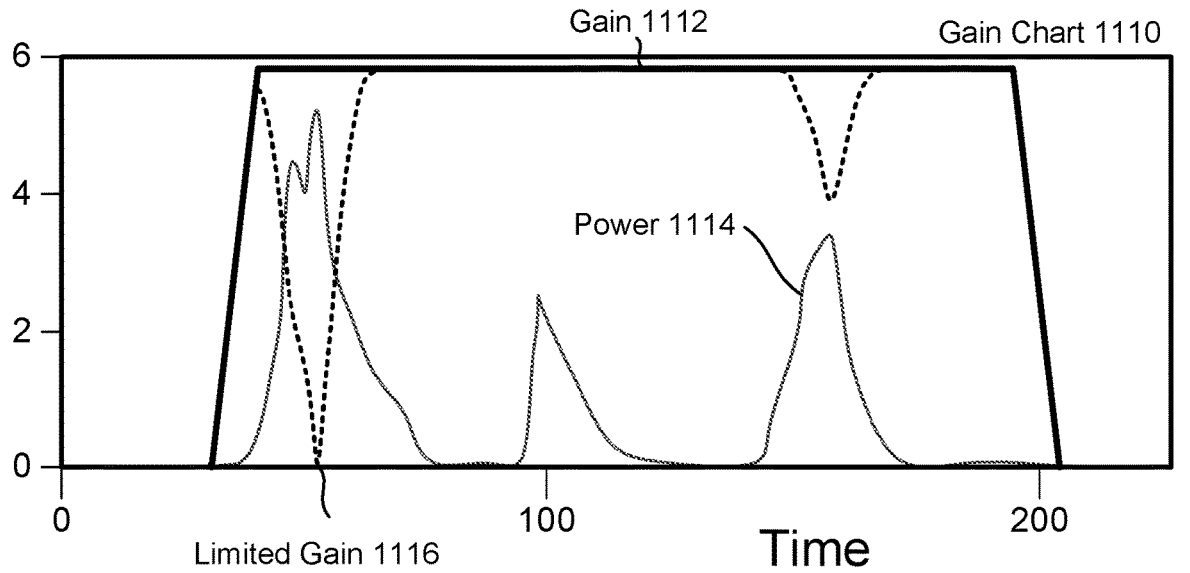
FIG. 11 illustrates an example of output power values exceeding a desired threshold and corresponding gain drops according to examples of the present disclosure.
Figure 11:
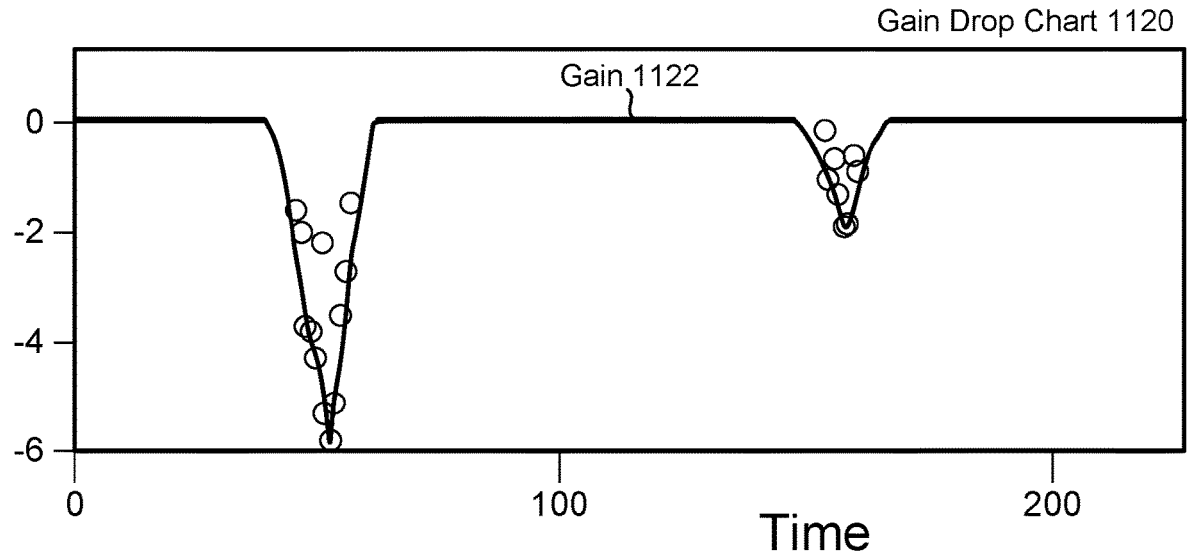

FIG. 11 illustrates an example of output power values exceeding a desired threshold and corresponding gain drops according to examples of the present disclosure. As illustrated by the gain chart 1110 in FIG. 11, the server(s) 120 may determine a gain 1112 for an active interval. However, by multiplying the gain 1112 by the power 1114 of the active interval, the server(s) 120 may determine that the output audio data exceeds the desired output loudness in a first peak and a third peak. Thus, the server(s) 120 may determine a first gain for the first peak and a second gain for the third peak, represented by limited gain 1116. As a result, the gain 1112 is replaced with the limited gain 1116 so that the output audio data does not exceed the desired output loudness, as illustrated in gain drop chart 1120. The circles in the gain drop chart 1120 indicate the amount of gain to drop at different audio frames, while the gain 1122 represents the gain for all of the audio frames.

In some examples, the server(s) 120 may determine the gain for an active interval based on a peak power included in the active interval, such that the server(s) 120 only calculate the limited gain 1116 when the peak power exceeds the desired output loudness (e.g., only in small portions of the active interval). However, the disclosure is not limited thereto and in some examples, the server(s) 120 may calculate the gain for the active interval based on an average power, a second or third peak power, or the like. For example, the server(s) 120 may have determined the gain 1112 based on the second peak in the power 1114, intentionally increasing the second peak to the desired output loudness and then determining the limited gain 1116 so that the first peak and the third peak were also output at the desired output loudness. Using this technique, the server(s) 120 may increase a percentage of the active interval that is at the desired output loudness.

In some examples, the server(s) 120 may determine a gain for an active interval and then may average the gain using a lowpass filter to smooth the output gain. However, the smoothed gains may be significantly lower than the intended gains. In addition, in many instances the strong voiced portion of a word is surrounded by weaker unvoiced waveforms that carry important information, such as consonants.

Figure 12:
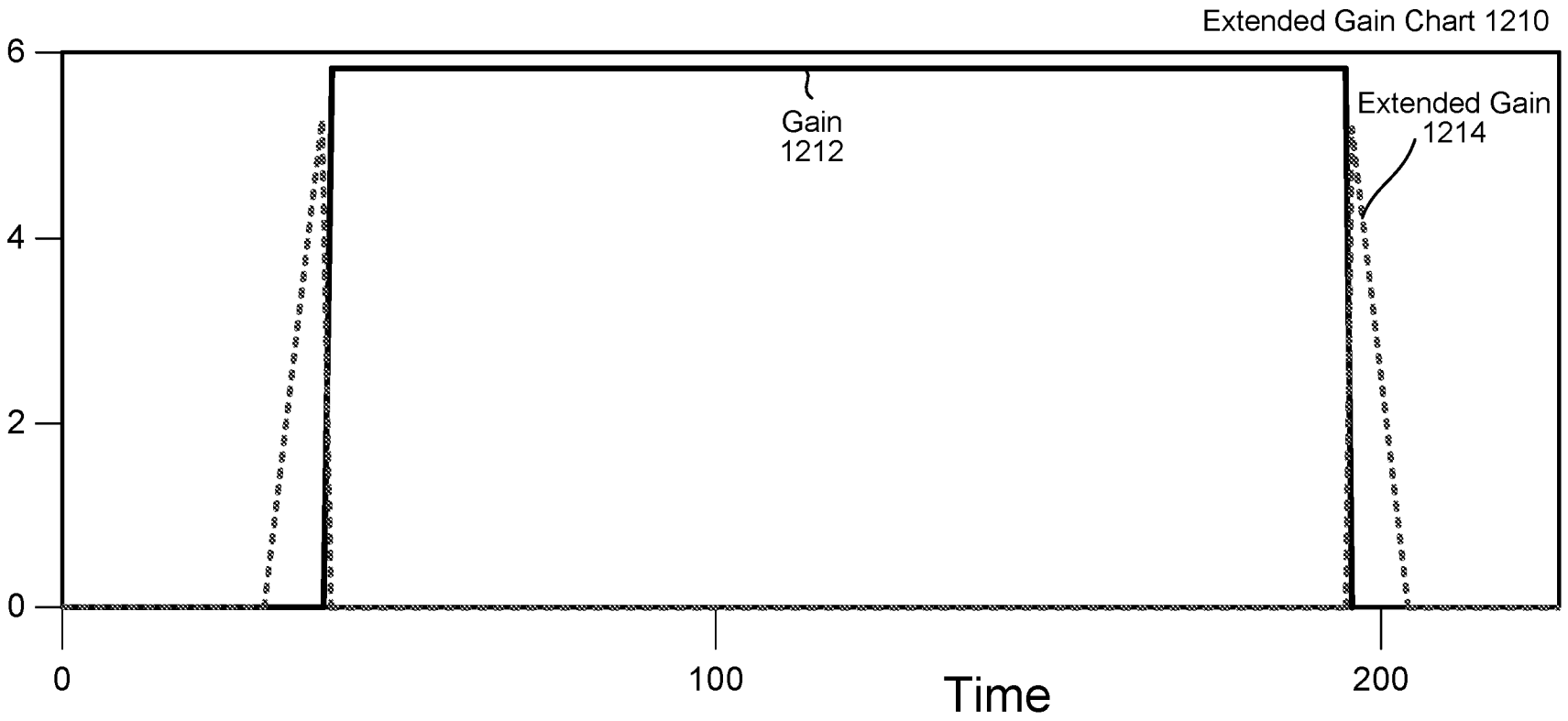
FIG. 12 illustrates an example of extended gain regions according to examples of the present disclosure.

Smoothing the gain using the lowpass filter may result in a de-emphasis at the borders of the word, which may cause undesired suppression of the consonants. To avoid these issues, the server(s) 120 may extend the gain in either direction based on a gain drop rate, as illustrated in FIG. 12. By extending the gain at the border of the interval, the server(s) 120 may transition between different gain values without abrupt changes that may cause distortion or other degradations of the audio data.

FIG. 12 illustrates an example of extended gain regions according to examples of the present disclosure. As illustrated by extended gain chart 1210 in FIG. 12, the server(s) 120 may determine a gain 1212 for an active interval and then may extend the edges of the active interval to transition to the gain. By adding the extended gain 1214 on either side of the active interval, the server(s) 120 may preserve most of the strong voiced portion, with a high probability of including the weaker consonants nearby, without suppressing the already decided gains in the middle of the active interval.

The server(s) 120 may perform voice activity detection to identify active intervals (e.g., audio frames having a power level above a threshold value, which correspond to a signal) and inactive intervals (e.g., audio frames having a power level below the threshold value, which correspond to noise). The server(s) 120 may apply individual gains to the active intervals and may apply a minimum gain to the inactive intervals. When the inactive intervals are short, however, transitioning between a high gain and the minimum gain may result in distortion or the amplification of low level noise. To avoid issues caused by short inactive intervals, the server(s) 120 may identify these short inactive intervals and merge them with surrounding active intervals. For example, the server(s) 120 may set audio frames included in the short inactive intervals as active.

Figure 13A:
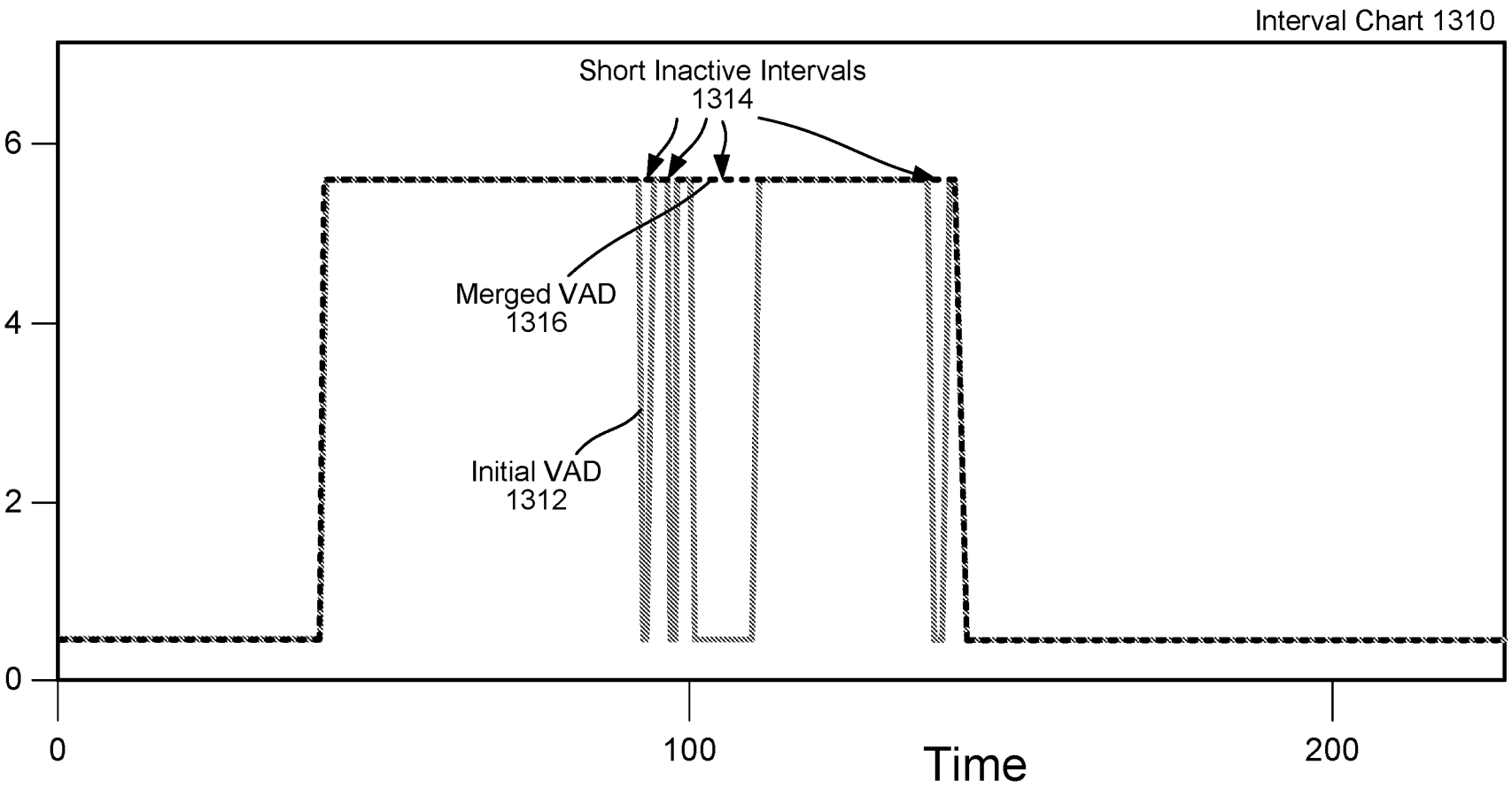
FIGS. 13A-13B illustrates examples of merging short inactive intervals and merging short active intervals according to examples of the present disclosure.

FIG. 13A illustrates an example of merging short inactive intervals according to examples of the present disclosure. As illustrated in FIG. 13A, interval chart 1310 illustrates an initial VAD 1312 that includes a number of short inactive intervals 1314. The server(s) 120 may identify the short inactive intervals by determining a length of the inactive intervals and identifying inactive intervals having a length below a time threshold (e.g., 16 audio frames). For example, the server(s) 120 may identify the short inactive intervals 1314. By setting the short inactive intervals 1314 to be active, the server(s) 120 may generate merged VAD 1316, which includes a single interval instead of five separate intervals.

Similarly, when active intervals are short, transitioning between the minimum gain and a high gain may result in distortion or the amplification of low level noise. To avoid issues caused by short active intervals, the server(s) 120 may identify these short active intervals and merge them with surrounding inactive intervals. For example, the server(s) 120 may set audio frames included in the short active intervals as inactive.

Figure 13B:
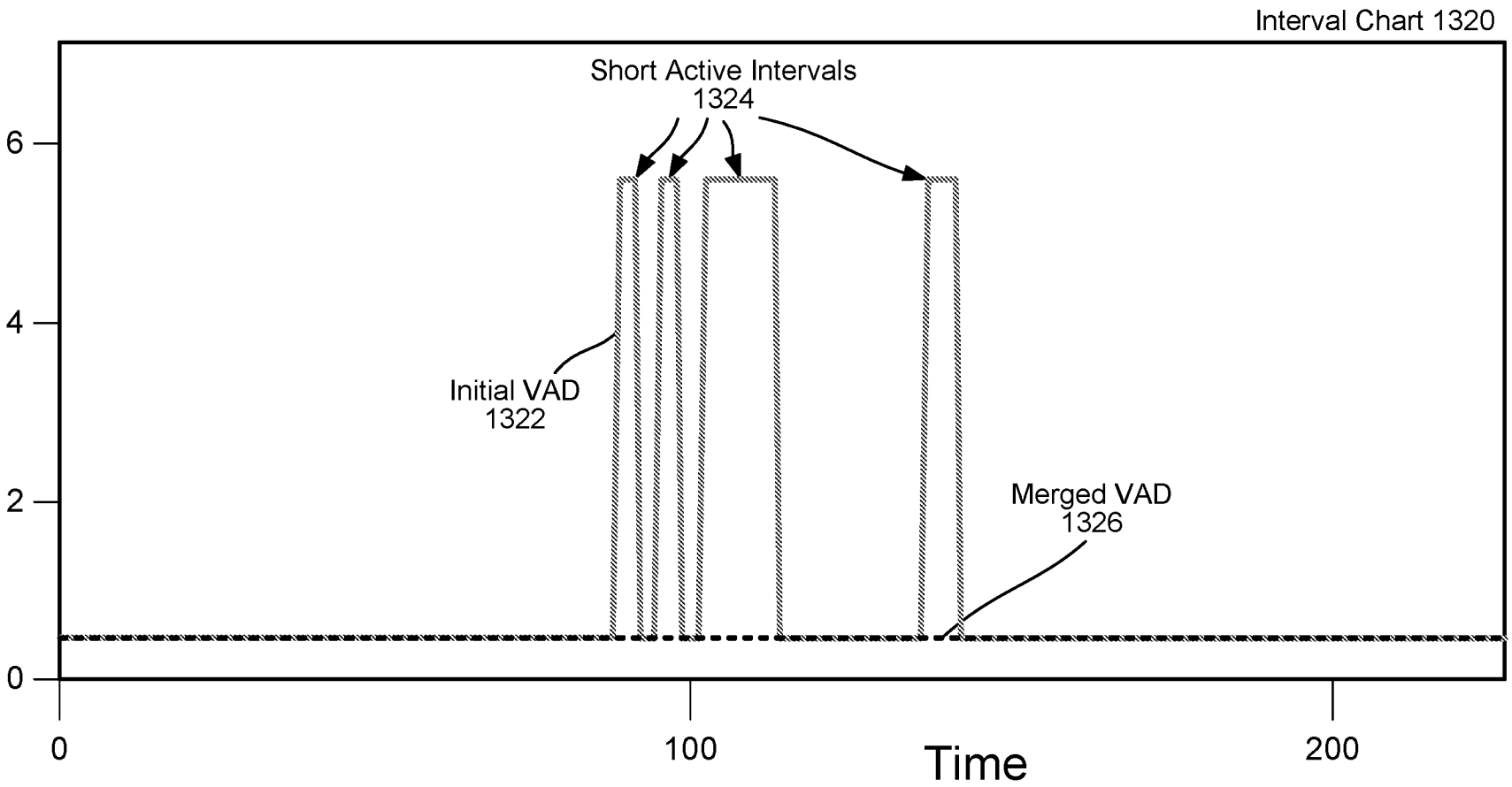

FIG. 13B illustrates an example of merging short active intervals according to examples of the present disclosure. As illustrated in FIG. 13B, interval chart 1320 illustrates an initial VAD 1322 that includes a number of short active intervals 1324. The server(s) 120 may identify the short active intervals by determining a length of the active intervals and identifying active intervals having a length below the time threshold (e.g., 16 audio frames). For example, the server(s) 120 may identify the short active intervals 1324. By setting the short active intervals 1324 to be inactive, the server(s) 120 may generate merged VAD 1326, which includes a single inactive interval instead of four active intervals.

In some examples, the server(s) 120 may set active intervals as inactive. For example, if a noise floor increases, an active interval may correspond to noise and not to an actual signal. The server(s) 120 may determine if an active interval corresponds to noise instead of a signal based on an average zero crossing rate. For example, an audio frame having a strong signal and limited noise may have a relatively low zero crossing rate (ZCR), whereas an audio frame having a weak signal and a lot of noise may have a relatively high ZCR. Thus, the server(s) 120 may determine average zero crossing rates (ZCRs) for active intervals, may determine intervals with average ZCR above a power threshold and may set audio frames included in the intervals as inactive.

Figure 14:
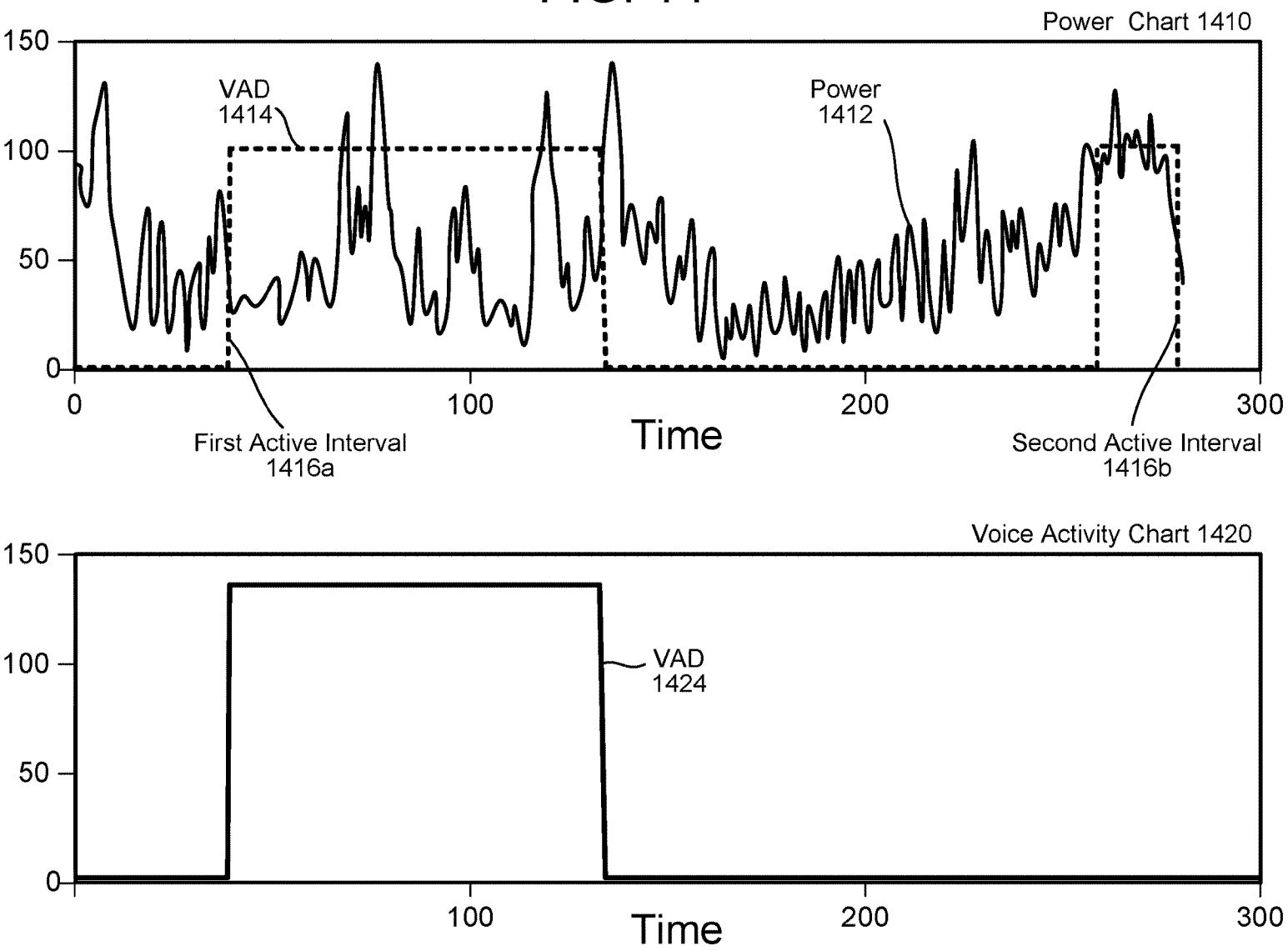
FIG. 14 illustrates an example of removing an active interval based on an average zero crossing rate according to examples of the present disclosure.

FIG. 14 illustrates an example of removing an active interval based on an average zero crossing rate according to examples of the present disclosure. As illustrated in FIG. 14, a power chart 1410 illustrates a power signal 1412 and a corresponding VAD 1414, which includes a first active interval 1416*a* and a second active interval 1416*b*. As illustrated in FIG. 14, the first active interval corresponds to a low noise floor and relatively high peaks, indicating a strong signal, whereas the second active interval 1416*b* corresponds to a high noise floor and relatively low peaks. For example, the second active interval 1416*b* may include high frequency content that increases the noise floor. Thus, the server(s) 120 may determine a first average zero crossing rate for the first active interval 1416*a* and a second average zero crossing rate for the second active interval 1416*b* and may determine that the second zero crossing rate is above a threshold value. Based on the second average zero crossing rate being above the threshold value, the server(s) 120 may set the second active interval 1416*b* as inactive. For example, voice activity chart 1420 illustrates VAD 1424, which includes the first active interval 1416*a* but does not include the second active interval 1416*b*.

Figure 15:
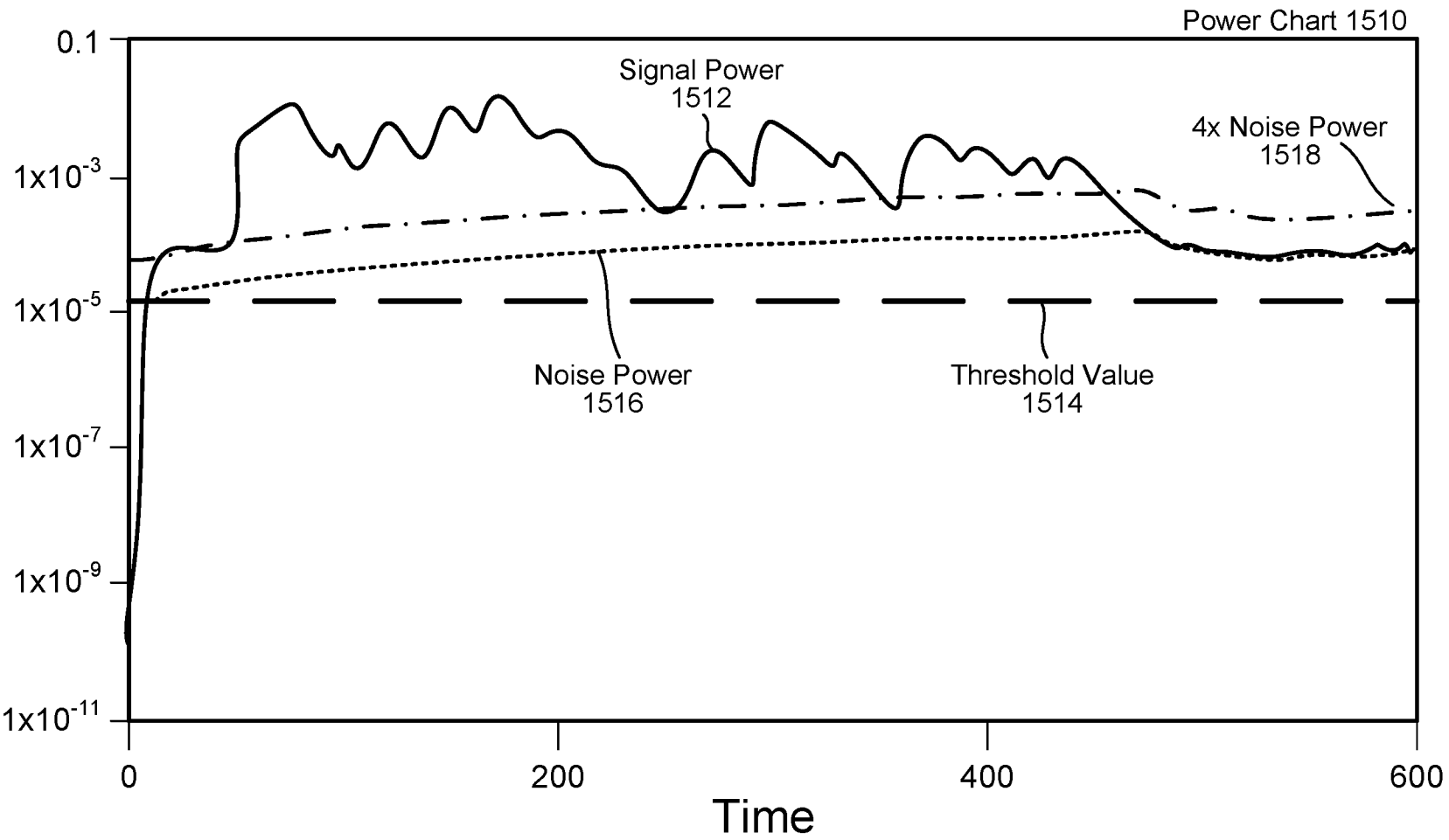
FIG. 15 illustrates an example of background noise power estimates according to examples of the present disclosure.

FIG. 15 illustrates an example of background noise power estimates according to examples of the present disclosure. As illustrated in FIG. 15, a power chart 1510 includes signal power 1512. Based on the signal power 1512, the server(s) 120 may determine a threshold value 1514, for example by multiplying a peak power value by a power factor (e.g., 0.0005). The server(s) 120 may use the threshold value 1514 as a minimum value when estimating a noise floor. For example, when the estimate of the noise floor is above the threshold value 1514, the server(s) 120 may use the estimate as is, whereas when the estimate of the noise floor is below the threshold value 1514, the server(s) 120 may substitute the noise floor 1514. Thus, the estimate of the noise floor is at a minimum equal to or greater than the threshold value 1514. Specifically, the threshold value 1514 is beneficial when the signal power 1512 is near zero, such as at the beginning of the power chart 1510.

By substituting the threshold value 1514 for the estimated noise floor, the server(s) 120 may determine noise power 1516, which is an accurate estimate of the noise. In some examples, the server(s) 120 may multiply the noise power 1516 by a noise multiple (e.g., 4×) to determine 4× noise power 1518. The server(s) 120 may use 4× noise power 1518 to determine which audio frames are active or inactive. For example, the server(s) 120 may compare a power level of each audio frame to the 4× noise power 1518 and may set audio frames below the 4× noise power 1518 as inactive.

In some examples, the server(s) 120 may determine the threshold value 1514, the noise power 1516 and the 4× noise power 1518 using the following equations:

$$\text{peakPower}=\max(\text{power}[m]) \quad (1)$$

$$p\text{Threshold}=\text{peakPower}*\text{POWER_TH_FACTOR} \quad (2)$$

$$\text{noiseIncMin}=\text{NOISE_MIN_FACTOR}*p\text{Threshold} \quad (3)$$

$$\text{smoothPower}=\text{powerAdaptationFactor}*\text{smoothPowerPast}+(1-\text{powerAdaptationFactor})*\text{power} \quad (4)$$

$$\text{noisePower}=\max(\min(\text{smoothPower},\max(\text{noiseAdaptationFactor}*\text{noisePowerPast},\text{noisePowerPast}+\text{noiseIncMin})),p\text{Threshold}) \quad (5)$$

where power[m] corresponds to input audio data (e.g., the signal power 1512 prior to filtering), peakPower is a maximum power of the input audio data, pThreshold is the threshold value 1514, POWER_TH_FACTOR is a power threshold factor (e.g., 0.0005), noiseIncMin is a noise increment value, NOISE_MIN_FACTOR is a noise factor (e.g., 0.02), smoothPower corresponds to filtered audio data (e.g., the signal power 1512), powerAdaptationFactor is a power adaptation factor (e.g., 0.9), smoothPowerPast is a smoothed power value of a previous audio frame (e.g., m−1 of the filtered audio data), power is a power value of the current audio frame (e.g., m of the input audio data), noisePower is a power value of a current audio frame in the noise power 1516, noiseAdaptationFactor is a noise adaptation factor (e.g., 1.0005), and noisePowerPast is a power value of the noise power 1516 in a previous audio frame (e.g., m−1 of the noise power 1516).

Thus, the server(s) 120 may calculate the noise power 1516 and the 4× noise power 1518 recursively (e.g., frame by frame) beginning with a first audio frame, with an initial smoothPowerPast initialized to a value of zero. While typical parameters of the variables mentioned above are listed, the disclosure is not limited thereto and the exact values used may vary without departing from the disclosure. For example, the server(s) 120 may modify the parameters between different audio data, with different parameters resulting in changes to the noise power 1516 and 4× noise power 1518. As an example, the power adaptation factor (e.g., powerAdaptationFactor) controls how much to weight smoothed the power value of a previous audio frame (e.g., smoothPowerPast), with a value of 0.9 corresponding to a 90%/10% weighting between the previous audio frame and the current audio frame (e.g., 90% of the estimate comes from the previous estimate, with only 10% coming from the current power value of the input audio data). Similarly, a noise adaptation factor (e.g., noiseAdaptationFactor) value closer to one results in more smoothing, whereas a value closer to zero results in less smoothing.

Figure 16:
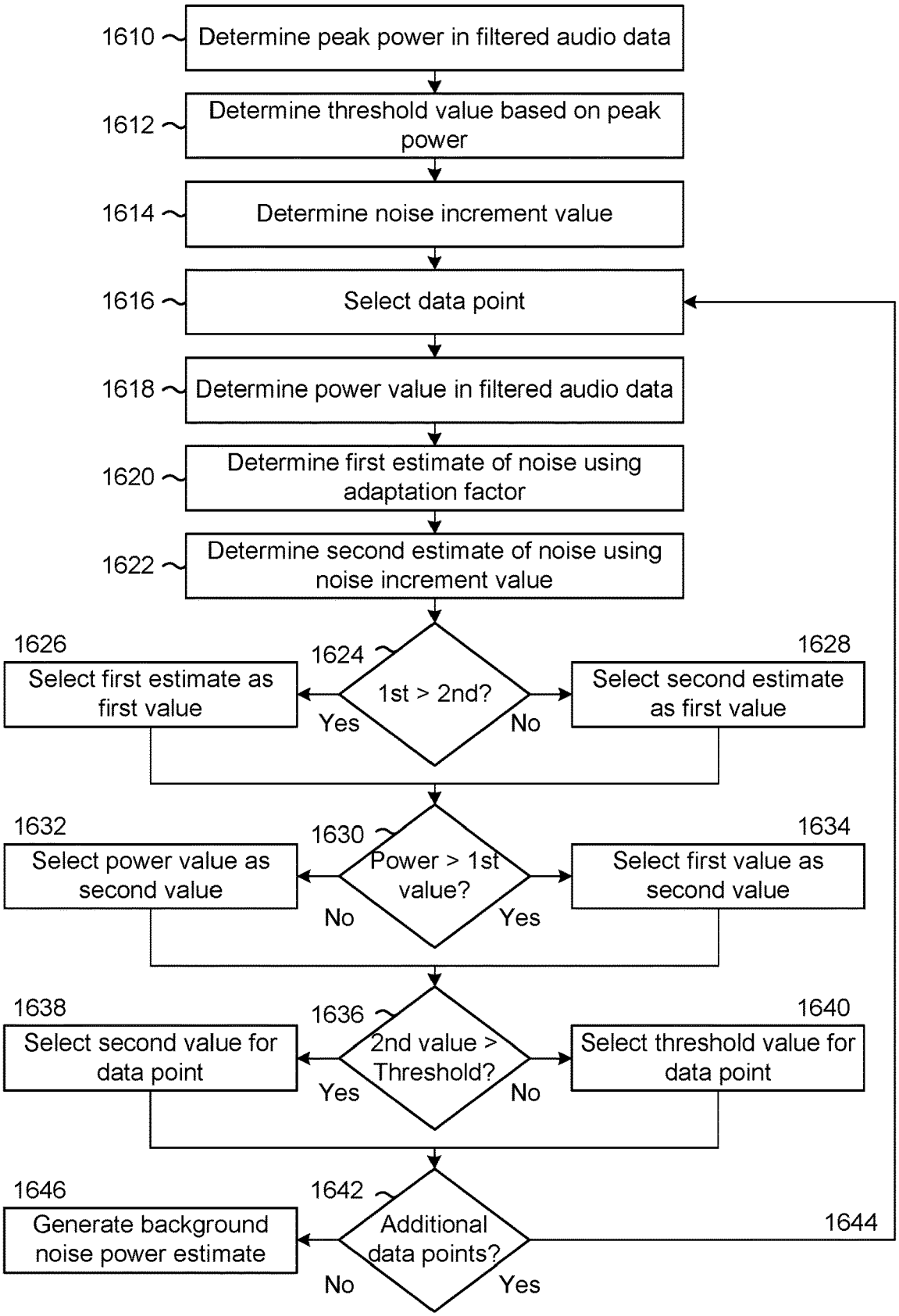
FIG. 16 is a flowchart conceptually illustrating an example method for estimating background noise power according to examples of the present disclosure.

FIG. 16 is a flowchart conceptually illustrating an example method for estimating background noise power according to examples of the present disclosure. As illustrated in FIG. 16, the server(s) 120 may determine (1610) peak power in filtered audio data, may determine (1612) a threshold value (e.g., threshold value 1514) based on the peak power and may determine (1614) a noise increment value. The threshold value may be determined by multiplying the peak power by a power factor (e.g., 0.0005), while the noise increment value may be determined by multiplying the threshold value by a noise factor (e.g., 0.02). As will be discussed in greater detail below, the threshold value is used as a minimum value for data points when determining the background noise power estimate, and audio frames with power lower than the threshold value are considered to be inactive. Additionally or alternatively, frames with power below a noise multiple (e.g., 4×) multiplied by the noise power may be considered to be inactive (e.g., 4× noise power 1518). The noise increment value is used as a minimum increase in noise between adjacent data points. As the noise increment value varies based on the threshold value (and therefore varies based on the peak power), the noise increment value changes from signal to signal.

The server(s) 120 may select (1616) a data point, may determine (1618) a power value of the data point in the filtered audio data, may determine (1620) a first estimate of noise using a noise adaptation factor and may determine (1622) a second estimate of noise using the noise increment value. The power value of the data point in the filtered audio data corresponds to an actual data point, whereas the first estimate and the second estimate correspond to estimates based on noise characteristics. For example, the first estimate may be determined by multiplying the noise adaptation factor by a previous noise power value (e.g., power value of a data point prior to the current data point), thus limiting the noise floor to being within a percentage increase of the previous data point. Similarly, the second estimate may be determined by adding the noise increment value to the previous noise power value, thus limiting the noise floor to being within the noise increment value above the previous data point.

The server(s) 120 may determine (1624) if the first estimate is larger than the second estimate. If the first estimate is larger, the server(s) 120 may select (1626) the first estimate as a first value and proceed to step 1630. If the second estimate is larger, the server(s) 120 may select (1628) the second estimate as the first value and proceed to step 1630. Therefore, the server(s) 120 may select the larger of the first estimate and the second estimate for further processing.

The server(s) 120 may determine (1630) if the power value (e.g., determined in step 1618) is larger than the first value (e.g., determined in 1626 or 1628). If the power value is not larger than the first value, the server(s) 120 may select (1632) the power value as a second value and proceed to step 1636. If the power value is larger, the server(s) 120 may select (1634) the first value as the second value and proceed to step 1636. Therefore, the server(s) 120 may select the smaller of the power value and the first value (e.g., larger of the first estimate and the second estimate) for further processing.

The server(s) 120 may determine (1636) if the second value is greater than the threshold value determined in step 1612. If the second value is larger than the threshold value, the server(s) 120 may select (1638) the second value as a value for the data point and proceed to step 1642. If the second value is not larger than the threshold value, the server(s) 120 may select (1640) the threshold value as a value of the data point and proceed to step 1642. Thus, the server(s) 120 may use the threshold value as a minimum noise level when the first estimate, second estimate and the actual power value of the data point are below the threshold value. For example, the threshold value may be used at the beginning and end of a signal when the power level drops near zero, increasing an accuracy of the noise prediction.

The server(s) 120 may determine (1642) if there are additional data points and, if there are additional data points, may loop (1644) to step 1616 and select an additional data point. If there are no additional data points, the server(s) 120 may generate (1646) a background noise power estimate based on the values selected for each of the data points. An example of the background noise power estimate is illustrated in FIG. 15 by noise power 1516.

Figure 17:
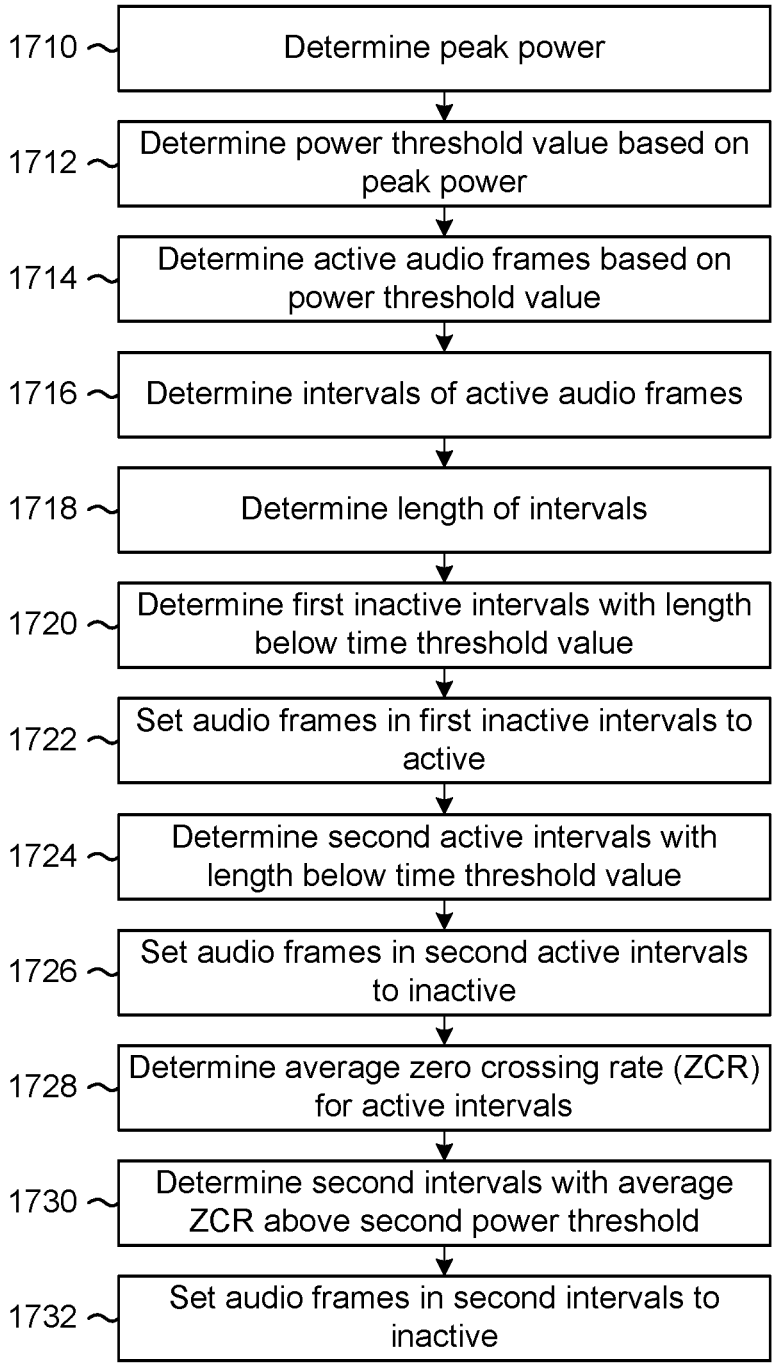
FIG. 17 is a flowchart conceptually illustrating an example method for performing voice activity detection according to examples of the present disclosure.

FIG. 17 is a flowchart conceptually illustrating an example method for performing voice activity detection (VAD) according to examples of the present disclosure. As illustrated in FIG. 17, the server(s) 120 may determine (1710) peak power and may determine (1712) a power threshold value based on the peak power. For example, the power threshold value may be determined by multiplying the peak power by a power factor (e.g., 0.0005). However, the disclosure is not limited thereto and the server(s) 120 may determine a variable power threshold based on the audio data. For example, the server(s) 120 may determine the power threshold value by determining the noise power 1516, the 4× noise power 1518 and/or the like, as described above with regard to FIGS. 15-16. In some examples, the server(s) 120 may determine the noise power 1516 and may multiply the noise power 1516 by a multiple (e.g., 4×) to determine the power threshold value. While FIG. 15 illustrates a multiple of four (e.g., 4× noise power 1518), the disclosure is not limited thereto and the multiple may vary based on the audio data. Thus, the power threshold value may vary between different signals and/or may vary within a single signal without departing from the disclosure.

The server(s) 120 may determine (1714) active audio frames based on the power threshold value. For example, audio frames with power lower than the power threshold value may be considered inactive. However the disclosure is not limited thereto and in some examples audio frames with power below a noise multiple (e.g., 4×) multiplied by the noise power may be considered to be inactive (e.g., 4× noise power 1518) without departing from the disclosure, as discussed above.

The server(s) 120 may determine (1716) intervals of active audio frames. For example, a series of active audio frames may be combined in an active interval, while a series of inactive frames may be combined in an inactive interval. Thus, determining the intervals of active audio frames may comprise identifying series of data points that exceed the power threshold value, the active intervals separated by series of data points that are below the power threshold value. In some examples, this step completes VAD, with the server(s) 120 outputting values of 0 for inactive audio frames and values of 1 for active audio frames. However, the disclosure is not limited thereto and optional further steps may enhance the VAD output.

In some examples, the server(s) 120 may optionally determine (1718) a length of intervals (e.g., determine a length of each interval), determine (1720) first inactive intervals with a length below a time threshold value (e.g., 16 audio frames), and may set (1722) audio frames included in the first inactive intervals to be active, as discussed above with regard to FIG. 13A. Additionally or alternatively, the server(s) 120 may optionally determine (1724) second active intervals with a length below the time threshold value (e.g., 16 audio frames), and may set (1726) audio frames included in the second active intervals to be inactive, as discussed above with regard to FIG. 13B. This avoids amplifying low level noise and transitioning from high gain to low gain unnecessarily, decreasing distortion and/or amplifying words properly.

In some examples, the server(s) 120 may optionally determine (1728) average zero crossing rates (ZCRs) for active intervals, may determine (1730) second intervals with average ZCR above a second power threshold and may set (1732) audio frames included in the second intervals to be inactive, as discussed above with regard to FIG. 14. For example, an audio frame having a strong signal and limited noise may have a relatively low ZCR, whereas an audio frame having a weak signal and a lot of noise (e.g., high frequency content) may have a relatively high ZCR. Thus, by measuring the ZCR, the server(s) 120 may identify audio frames with ZCR above the threshold and set them as inactive, ignoring these audio frames as corresponding to noise instead of a strong signal.

Figure 18:
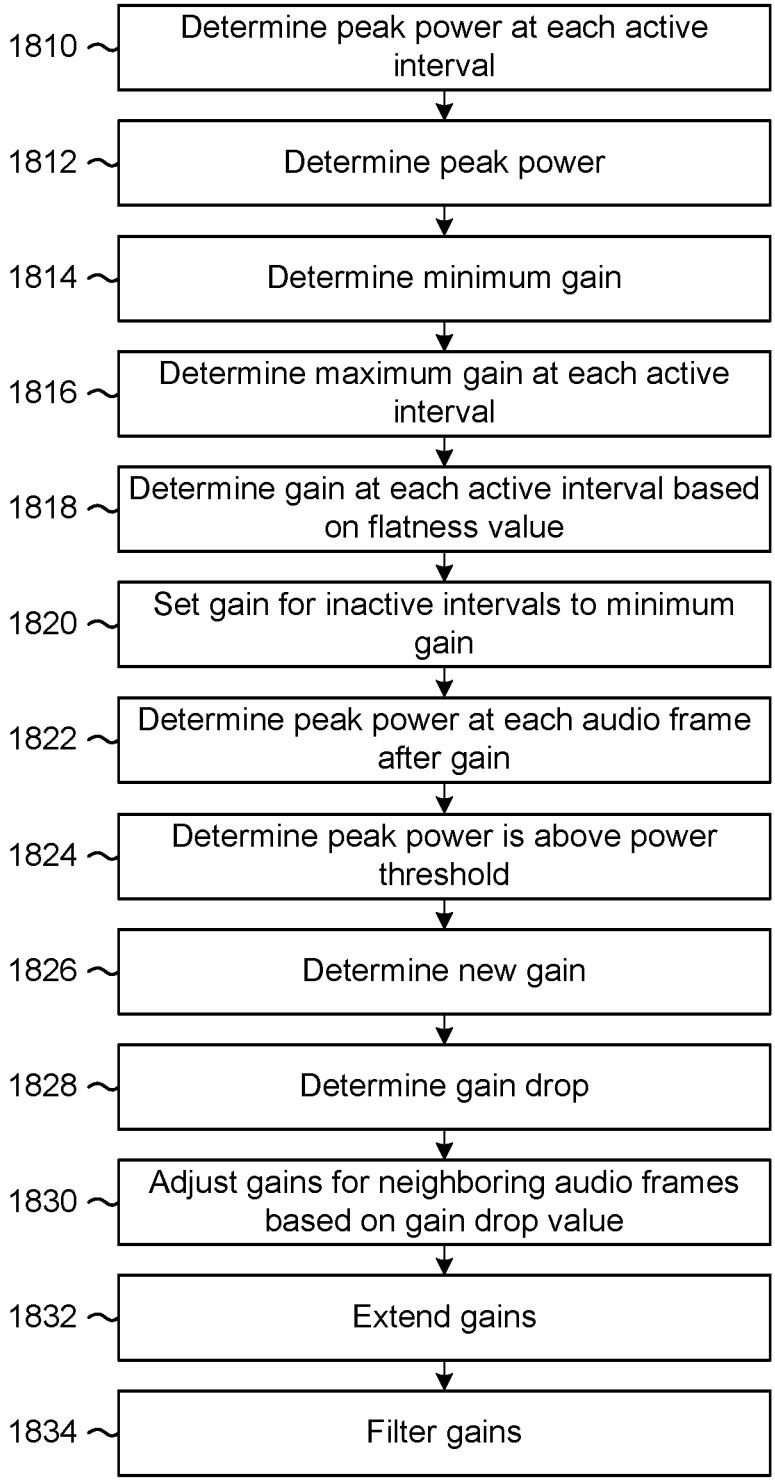
FIG. 18 is a flowchart conceptually illustrating an example method for determining gains according to examples of the present disclosure.

FIG. 18 is a flowchart conceptually illustrating an example method for determining gains according to examples of the present disclosure. As illustrated in FIG. 18, the server(s) 120 may determine (1810) peak power at each active interval, as described in greater detail above with regard to FIG. 6. Using the peak power, the server(s) 120 may determine (1812) a peak power for all of the intervals and may determine (1814) a minimum gain based on the peak power, as discussed in greater detail above with regard to FIG. 7A. The minimum gain corresponds to a lowest amount of gain to apply to all of the active intervals without exceeding a desired output loudness.

The server(s) 120 may determine (1816) a maximum gain at each active interval, as discussed above with regard to FIG. 7B, may determine (1818) a gain at each active interval based on a flatness value, as discussed above with regard to FIG. 8, and may set (1820) a gain for inactive intervals to the minimum gain determined in step 1814, as illustrated in FIG. 9. Thus, inactive intervals receive the minimum gain used for normalization of the output audio data.

As discussed in greater detail above with regard to FIG. 11, the server(s) 120 may determine (1822) a peak power at each audio frame after applying the gain, may determine (1824) that a peak power is above a power threshold value (e.g., desired output loudness), may determine (1826) a new gain based on the desired output loudness, may determine (1828) a corresponding gain drop and may adjust (1830) gains for neighboring audio frames based on the gain drop value.

The server(s) 120 may extend (1832) gains, as described above with regard to FIG. 12, and may filter (1832) the gains using a low pass filter, although the disclosure is not limited thereto.

Figure 19:
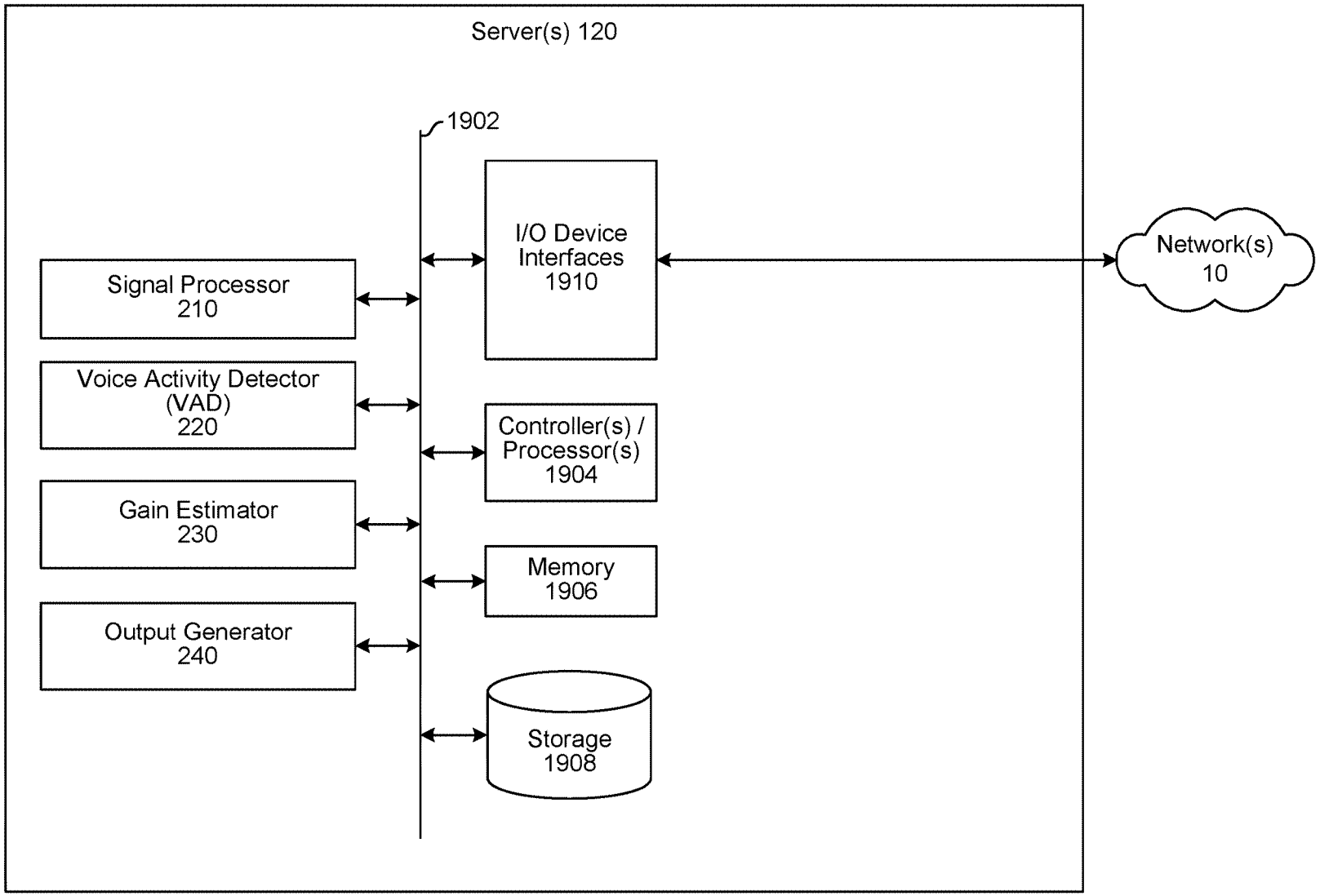
FIG. 19 is a block diagram conceptually illustrating example components of a system for voice enhancement according to embodiments of the present disclosure.

FIG. 19 is a block diagram conceptually illustrating example components of a system for voice enhancement according to embodiments of the present disclosure. In operation, the system 100 may include computer-readable and computer-executable instructions that reside on the server(s) 120, as will be discussed further below.

As illustrated in FIG. 19, the server(s) 120 may include an address/data bus 1902 for conveying data among components of the server(s) 120. Each component within the server(s) 120 may also be directly connected to other components in addition to (or instead of) being connected to other components across the bus 1902.

The server(s) 120 may include one or more controllers/processors 1904, that may each include a central processing unit (CPU) for processing data and computer-readable instructions, and a memory 1906 for storing data and instructions. The memory 1906 may include volatile random access memory (RAM), non-volatile read only memory (ROM), non-volatile magnetoresistive (MRAM) and/or other types of memory. The server(s) 120 may also include a data storage component 1908, for storing data and controller/processor-executable instructions (e.g., instructions to perform the algorithm illustrated in FIGS. 1, 16 17 and/or 18). The data storage component 1908 may include one or more non-volatile storage types such as magnetic storage, optical storage, solid-state storage, etc. The server(s) 120 may also be connected to removable or external non-volatile memory and/or storage (such as a removable memory card, memory key drive, networked storage, etc.) through the input/output device interfaces 1910.

The server(s) 120 includes input/output device interfaces 1910. A variety of components may be connected through the input/output device interfaces 1910.

The input/output device interfaces 1910 may be configured to operate with network(s) 10, for example a wireless local area network (WLAN) (such as WiFi), Bluetooth, ZigBee and/or wireless networks, such as a Long Term Evolution (LTE) network, WiMAX network, 3G network, etc. The network(s) 10 may include a local or private network or may include a wide network such as the internet. Devices may be connected to the network(s) 10 through either wired or wireless connections.

The input/output device interfaces 1910 may also include an interface for an external peripheral device connection such as universal serial bus (USB), FireWire, Thunderbolt, Ethernet port or other connection protocol that may connect to network(s) 10. The input/output device interfaces 1910 may also include a connection to an antenna (not shown) to connect one or more network(s) 10 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc.

The server(s) 120 may include a signal processor 210, a voice activity detector (VAD) 220, a gain estimator 230 and/or output generator 240, which may comprise processor-executable instructions stored in storage 1908 to be executed by controller(s)/processor(s) 1904 (e.g., software, firmware, hardware, or some combination thereof). For example, components of the signal processor 210, the VAD 220, the gain estimator 230 and/or the output generator 240 may be part of a software application running in the foreground and/or background on the server(s) 120. The remote control component 1924 may control the server(s) 120 as discussed above, for example with regard to FIGS. 1, 16 17 and/or 18. Some or all of the controllers/components of the signal processor 210, the VAD 220, the gain estimator 230 and/or the output generator 240 may be executable instructions that may be embedded in hardware or firmware in addition to, or instead of, software. In one embodiment, the server(s) 120 may operate using an Android operating system (such as Android 4.3 Jelly Bean, Android 4.4 KitKat or the like), an Amazon operating system (such as FireOS or the like), or any other suitable operating system.

Executable computer instructions for operating the server(s) 120 and its various components may be executed by the controller(s)/processor(s) 1904, using the memory 1906 as temporary "working" storage at runtime. The executable instructions may be stored in a non-transitory manner in non-volatile memory 1906, storage 1908, or an external device. Alternatively, some or all of the executable instructions may be embedded in hardware or firmware in addition to or instead of software.

The components of the server(s) 120, as illustrated in FIG. 19, are exemplary, and may be located a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, video game consoles, speech processing systems, distributed computing environments, etc. Thus the components, components and/or processes described above may be combined or rearranged without departing from the scope of the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Embodiments of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, comprising:

receiving first audio data;

determining a background noise power level associated with the first audio data;

determining a threshold value based on the background noise power level, the threshold value indicating whether voice activity is detected;

determining a first plurality of audio frames of the first audio data, each frame of the first plurality of audio frames having a power value above the threshold value, the first plurality of audio frames corresponding to voice activity, the first plurality of audio frames including at least a first portion and a second portion;

determining a second plurality of audio frames of the first audio data, each frame of the second plurality of audio frames having a power value below the threshold value, the second plurality of audio frames corresponding to noise, the second plurality of audio frames including a third portion that is between the first portion and the second portion;

determining a first peak power value of the first audio data, the first peak power value corresponding to the first portion;

determining a minimum gain to amplify the first peak power value to a desired power level, the desired power level corresponding to a maximum power value after normalization;

determining a second peak power value corresponding to the second portion;

determining a first gain to amplify the second peak power value to the desired power level;

determining a flatness value corresponding to an adjustment within a range bounded by the first gain and the minimum gain;

determining a second gain using the flatness value, the minimum gain, and the first gain; and generating second audio data at least by:

amplifying the first portion based on the minimum gain, and amplifying the second portion based on the second gain.

2. The computer-implemented method of claim 1, wherein determining the second gain further comprises:

determining a difference between the first gain and the minimum gain; and summing the minimum gain and a product of the flatness value and the difference.

3. A computer-implemented method, comprising:

determining that a first portion of first audio data corresponds to voice activity;

determining that a second portion of the first audio data corresponds to voice activity;

determining that a third portion of the first audio data does not correspond to voice activity, wherein the third portion is between the first portion and the second portion determining a first peak power value corresponding to the first portion;

determining a first gain to amplify the first peak power value to a first adjusted power level;

determining a second peak power value corresponding to the second portion;

determining a second gain to amplify the second peak power value to the first adjusted power level;

determining a flatness value corresponding to an adjustment within a range bounded by the first gain and the second gain;

determining a third gain using the flatness value, the first gain, and the second gain; and generating second audio data at least by:

amplifying the first portion based on the first gain, and amplifying the second portion based on the third gain.

4. The computer-implemented method of claim 3, further comprising:

determining that the flatness value is equal to zero; and setting the third gain equal to the first gain.

5. The computer-implemented method of claim 3, further comprising:

determining that the flatness value is equal to one; and setting the third gain equal to the second gain.

6. The computer-implemented method of claim 3, wherein determining the third gain further comprises:

determining a difference between the second gain and the first gain; and summing the first gain and a product of the flatness value and the difference.

7. The computer-implemented method of claim 3, further comprising:

determining, based on the third gain and the second peak power value, an output peak power value of a first audio frame in the second portion;

determining that the output peak power value is above a desired threshold value;

determining a fourth gain to amplify the second peak power value to the desired threshold value; and determining a difference between the third gain and the fourth gain, wherein the generating the second audio data further comprises:

amplifying the first audio frame based on the fourth gain, amplifying one or more audio frames in proximity to the first audio frame based on the third gain and a portion of the difference, and amplifying remaining audio frames of the second portion based on the third gain.

8. The computer-implemented method of claim 3, further comprising:

determining a first audio sample in the first portion corresponding to a transition between the first portion and the third portion;

determining a second audio sample in the third portion, the second audio sample following the first audio sample;

determining a third audio sample in the third portion, the third audio sample following the second audio sample;

determining a fourth audio sample in the third portion, the fourth audio sample separated from the first audio sample by a number of audio samples including the second audio sample and the third audio sample;

determining a difference between the third gain and the first gain;

determining a gain decrement value by dividing the difference by the number of audio samples;

determining a first intermediate gain corresponding to the second audio sample by subtracting the gain decrement value from the third gain; and determining a second intermediate gain corresponding to the third audio sample by subtracting the gain decrement value from the first intermediate gain, wherein the generating the second audio data further comprises:

amplifying the first audio sample using the third gain, amplifying the second audio sample using the first intermediate gain, amplifying the third audio sample using the second intermediate gain, and amplifying the fourth audio sample using the first gain.

9. The computer-implemented method of claim 3, wherein:

determining that the first portion corresponds to voice activity comprises determining that first audio frames included in the first portion have a power value above a first threshold value;

determining that the second portion corresponds to voice activity comprises determining that second audio frames included in the second portion have a power value above the first threshold value; and determining that the third portion does not correspond to voice activity comprises determining that third audio frames included in the third portion have a power value below the first threshold value.

10. The computer-implemented method of claim 9, further comprising:

determining a first plurality of audio frames in the first audio data, each audio frame of the first plurality of audio frames having a power value above the first threshold value;

determining a second plurality of audio frames in the first audio data, the second plurality of audio frames following the first plurality of audio frames, each audio frame of the second plurality of audio frames having a power value below the first threshold value;

determining a third plurality of audio frames in the first audio data, the third plurality of audio frames following the second plurality of audio frames, each audio frame of the third plurality of audio frames having a power value above the first threshold value;

determining a number of the second plurality of audio frames;

determining that the number of the second plurality of audio frames is below a second threshold value; and selecting the first plurality of audio frames, the second plurality of audio frames and the third plurality of audio frames as the first portion.

11. The computer-implemented method of claim 9, further comprising:

determining a first plurality of audio frames in the first audio data, each audio frame of the first plurality of audio frames having a power value above the first threshold value;

determining a second plurality of audio frames in the first audio data, each audio frame of the second plurality of audio frames having a power value below the first threshold value;

determining an average zero crossing rate value corresponding to the first plurality of audio frames;

determining that the average zero crossing rate value is above a second threshold value; and selecting the first plurality of audio frames and the second plurality of audio frames as the third portion.

12. The computer-implemented method of claim 9, further comprising:

determining a third peak power value of the first audio data;

determining, based on the third peak power value, a second threshold value;

determining that a first power level of a first audio sample is above the second threshold value;

determining that a second power level of a second audio sample is below the second threshold value;

storing the second threshold value as the second power level; and determining a background noise power level based on the first power level and the second power level.

13. A computing system, comprising:

at least one processor; and memory including instructions that, when executed by the at least one processor, cause the computing system to:

determine that a first portion of first audio data corresponds to voice activity;

determine that a second portion of the first audio data corresponds to voice activity;

determine that a third portion of the first audio data does not correspond to voice activity, wherein the third portion is between the first portion and the second portion;

determine a first peak power value corresponding to the first portion;

determine a first gain to amplify the first peak power value to a first adjusted power level;

determine a second peak power value corresponding to the second portion;

determine a second gain to amplify the second peak power value to the first adjusted power level;

determining a flatness value corresponding to an adjustment within a range bounded by the first gain and the second gain;

determine a third gain using the flatness value, the first gain, and the second gain; and generate second audio data at least by:

amplifying the first portion based on the first gain, and amplifying the second portion based on the third gain.

14. The computing system of claim 13, wherein the memory includes additional instructions which, when executed by the at least one processor, further cause the computing system to:

determine that the flatness value is equal to one;

and set the third gain equal to the second gain.

15. The computing system of claim 13, wherein the memory includes additional instructions which, when executed by the at least one processor, further cause the computing system to determine the third gain at least by:

determining a difference between the second gain and the first gain; and summing the first gain and a product of the flatness value and the difference.

16. The computing system of claim 13, wherein the memory includes additional instructions which, when executed by the at least one processor, further cause the computing system to:

determine, based on the third gain and the second peak power value, an output peak power value of a first audio frame in the second portion;

determine that the output peak power value is above a desired threshold value;

determine a fourth gain to amplify the second peak power value to the desired threshold value; and determine a difference between the third gain and the fourth gain, wherein the generating the second audio data further comprises:

amplifying the first audio frame based on the fourth gain, amplifying one or more audio frames in proximity to the first audio frame based on the third gain and a portion of the difference, and amplifying remaining audio frames of the second portion based on the third gain.

17. The computing system of claim 13, wherein the memory includes additional instructions which, when executed by the at least one processor, further cause the computing system to:

determine that the first portion corresponds to voice activity at least by determining that first audio frames included in the first portion have a power value above a first threshold value;

determine that the second portion corresponds to voice activity at least by determining that second audio frames included in the second portion have a power value above the first threshold value; and determine that the third portion does not correspond to voice activity at least by determining that third audio frames included in the third portion have a power value below the first threshold value.

18. The computing system of claim 17, wherein the memory includes additional instructions which, when executed by the at least one processor, further cause the computing system to:

determine a first plurality of audio frames in the first audio data, each audio frame of the first plurality of audio frames having a power value above the first threshold value;

determine a second plurality of audio frames in the first audio data, the second plurality of audio frames following the first plurality of audio frames, each audio frame of the second plurality of audio frames having a power value below the first threshold value;

determine a third plurality of audio frames in the first audio data, the third plurality of audio frames following the second plurality of audio frames, each audio frame of the third plurality of audio frames having a power value above the first threshold value;

determine a number of the second plurality of audio frames;

determine that the number of the second plurality of audio frames is below a second threshold value; and select the first plurality of audio frames, the second plurality of audio frames and the third plurality of audio frames as the first portion.

19. The computing system of claim 17, wherein the memory includes additional instructions which, when executed by the at least one processor, further cause the computing system to:

determine a first plurality of audio frames in the first audio data, each audio frame of the first plurality of audio frames having a power value above the first threshold value;

determine a second plurality of audio frames in the first audio data, each audio frame of the second plurality of audio frames having a power value below the first threshold value;

determine an average zero crossing rate value corresponding to the first plurality of audio frames;

determine that the average zero crossing rate value is above a second threshold value; and select the first plurality of audio frames and the second plurality of audio frames as the third portion.

20. The computing system of claim 17, wherein the memory includes additional instructions which, when executed by the at least one processor, further cause the computing system to:

determine a third peak power value of the first audio data;

determine, based on the third peak power value, a second threshold value;

determine that a first power level of a first audio sample is above the second threshold value;

determine that a second power level of a second audio sample is below the second threshold value;

store the second threshold value as the second power level; and determine a background noise power level based on the first power level and the second power level.

* * * * *